US010507657B2

(12) United States Patent
Takahashi et al.

(10) Patent No.: US 10,507,657 B2
(45) Date of Patent: Dec. 17, 2019

(54) LIQUID DISCHARGE HEAD, LIQUID DISCHARGE DEVICE, AND LIQUID DISCHARGE APPARATUS

(71) Applicant: RICOH COMPANY, LTD., Tokyo (JP)

(72) Inventors: Aki Takahashi, Kanagawa (JP); Hitoshi Usami, Kanagawa (JP); Masaki Kato, Tokyo (JP); Masataka Yoshiike, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 5 days.

(21) Appl. No.: 15/363,282

(22) Filed: Nov. 29, 2016

(65) Prior Publication Data

US 2017/0151782 A1 Jun. 1, 2017

(30) Foreign Application Priority Data

Dec. 1, 2015 (JP) ..... 2015-234424
Jan. 18, 2016 (JP) ..... 2016-007280
Nov. 7, 2016 (JP) ..... 2016-217642

(51) Int. Cl.
*B41J 2/14* (2006.01)

(52) U.S. Cl.
CPC ..... *B41J 2/14233* (2013.01)

(58) Field of Classification Search
None
See application file for complete search history.

(56) References Cited

U.S. PATENT DOCUMENTS 6,286,941 B1 * 9/2001 Courian ..... B41J 2/1404 347/65
2003/0189619 A1 * 10/2003 Shino ..... B41J 2/14209 347/50
2006/0243701 A1 * 11/2006 Ono ..... B41J 2/14072 216/27

(Continued)

FOREIGN PATENT DOCUMENTS

JP 5-038812 2/1993
JP 11-179919 7/1999

(Continued)

OTHER PUBLICATIONS

U.S. Appl. No. 15/268,718, filed Sep. 19, 2016.
U.S. Appl. No. 15/334,664, filed Oct. 26, 2016.

*Primary Examiner* — Erica S Lin
(74) *Attorney, Agent, or Firm* — Oblon, McClelland, Maier & Neustadt, L.L.P.

(57) ABSTRACT

A liquid discharge head includes a nozzle plate, a channel substrate, a common-liquid-chamber substrate, an adhesive, and a sealant. The nozzle plate includes a plurality of nozzles to discharge liquid. The channel substrate includes a plurality of individual liquid chambers communicated with the plurality of nozzles. The common-liquid-chamber substrate includes a common liquid chamber to supply the liquid to the plurality of individual liquid chambers. The adhesive bonds two of the nozzle plate, the channel substrate, and the common-liquid-chamber substrate. The adhesive faces a channel through which the liquid flows. The sealant surrounds the adhesive at an opposite side of the channel relative to the adhesive.

20 Claims, 30 Drawing Sheets

(56) References Cited

U.S. PATENT DOCUMENTS

| | | | | |
|---|---|---|---|---|
| 2009/0058945 | A1* | 3/2009 | Bernard | B41J 2/16 347/54 |
| 2009/0091604 | A1* | 4/2009 | Bell | B41J 2/1603 347/64 |
| 2009/0115833 | A1* | 5/2009 | Soulliaert | B41J 2/45 347/238 |
| 2013/0070026 | A1* | 3/2013 | Kuwata | B41J 2/14274 347/47 |
| 2013/0194352 | A1* | 8/2013 | Watanabe | B41J 2/14233 347/71 |
| 2015/0367638 | A1* | 12/2015 | Hanagami | B41J 2/1433 347/44 |
| 2015/0375505 | A1 | 12/2015 | Takahashi | |
| 2016/0096386 | A1 | 4/2016 | Yoshiike | |

FOREIGN PATENT DOCUMENTS

| | | | |
|---|---|---|---|
| JP | 2002-054855 | | 2/2002 |
| JP | 2002-248757 | | 9/2002 |
| JP | 2003-136734 | | 5/2003 |
| JP | 2003136734 | A * | 5/2003 |
| JP | 2003-326708 | | 11/2003 |
| JP | 2005-096366 | | 4/2005 |
| JP | 2007-038629 | | 2/2007 |
| JP | 2007-112075 | | 5/2007 |
| JP | 2007-318870 | | 12/2007 |
| JP | 2013-123802 | | 6/2013 |
| JP | 2015-107633 | | 6/2015 |

* cited by examiner

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2015-234424 filed on Dec. 1, 2015, 2016-007280 filed on Jan. 18, 2016, and 2016-217642 filed on Nov. 7, 2016 in the Japan Patent Office, the entire disclosure of each of which is hereby incorporated by reference herein.

BACKGROUND

Technical Field

Aspects of the present disclosure relate to a liquid discharge head, a liquid discharge device, and a liquid discharge apparatus.

Related Art

A liquid discharge head may include, for example, a holding substrate (also referred to as protective substrate) bonded on an actuator substrate. The holding substrate covers a plurality of pressure generating elements arrayed on the actuator substrate. The holding substrate is bonded to a common-liquid-chamber substrate with adhesive. The common-liquid-chamber substrate includes a common liquid chamber to supply liquid to individual liquid chambers.

SUMMARY

In an aspect of the present disclosure, there is provided a liquid discharge head that includes a nozzle plate, a channel substrate, a common-liquid-chamber substrate, an adhesive, and a sealant. The nozzle plate includes a plurality of nozzles to discharge liquid. The channel substrate includes a plurality of individual liquid chambers communicated with the plurality of nozzles. The common-liquid-chamber substrate includes a common liquid chamber to supply the liquid to the plurality of individual liquid chambers. The adhesive bonds two of the nozzle plate, the channel substrate, and the common-liquid-chamber substrate. The adhesive faces a channel through which the liquid flows. The sealant surrounds the adhesive at an opposite side of the channel relative to the adhesive.

In another aspect of the present disclosure, there is provided a liquid discharge device that includes the liquid discharge head to discharge the liquid.

In still another aspect of the present disclosure, there is provided a liquid discharge apparatus that includes the liquid discharge device to discharge the liquid.

In still yet another aspect of the present disclosure, there is provided a liquid discharge apparatus that includes the liquid discharge head to discharge the liquid.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
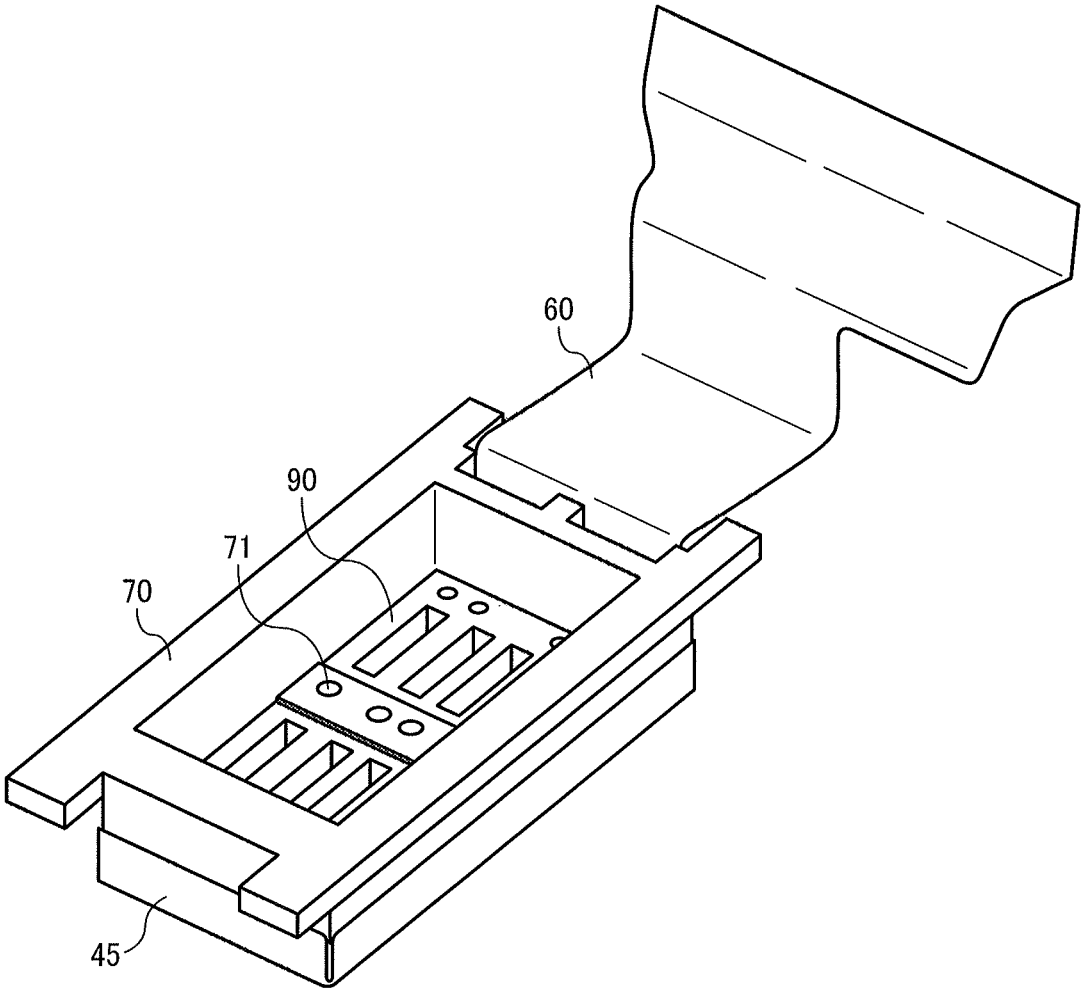
FIG. 1 is a perspective view of an example of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
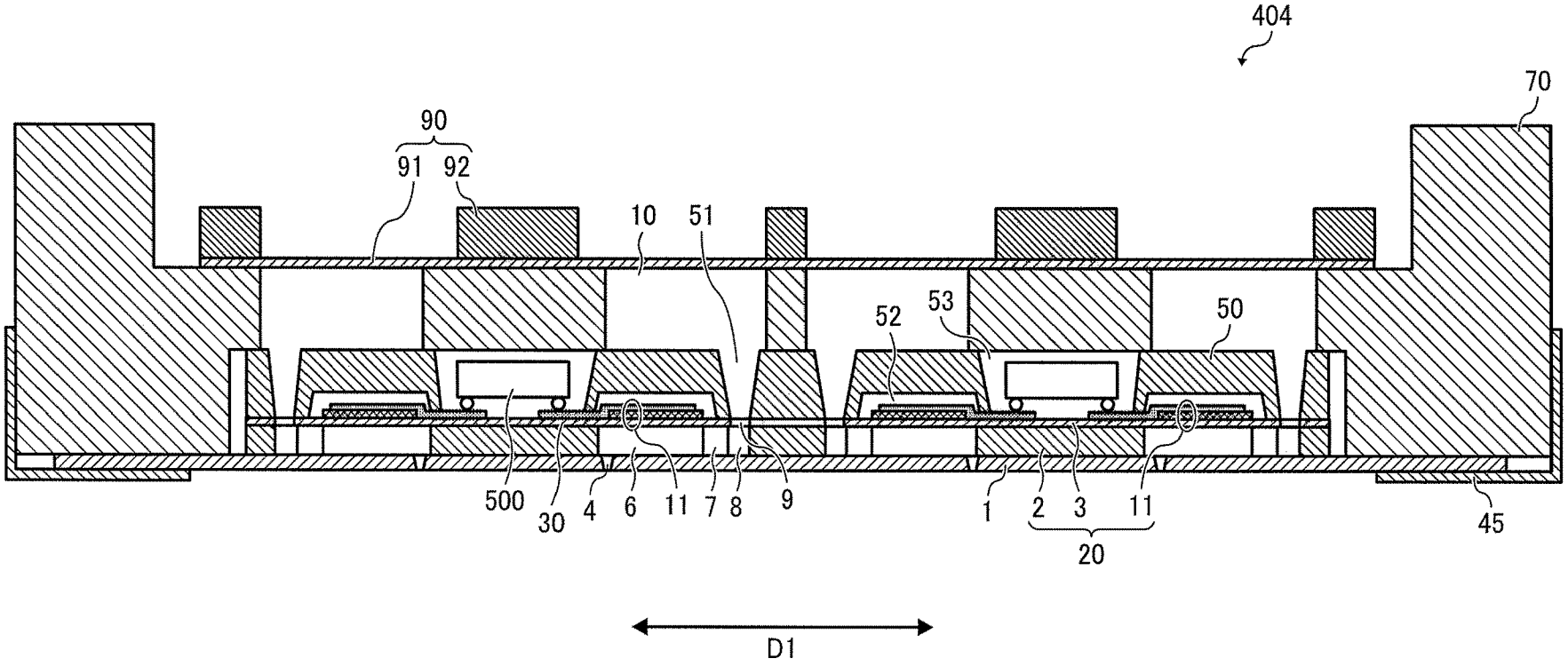
FIG. 2 is a cross-sectional view of a portion of the liquid discharge head of FIG. 1 cut along a direction perpendicular to a nozzle array direction in which nozzles are arrayed in row.
Figure 3:
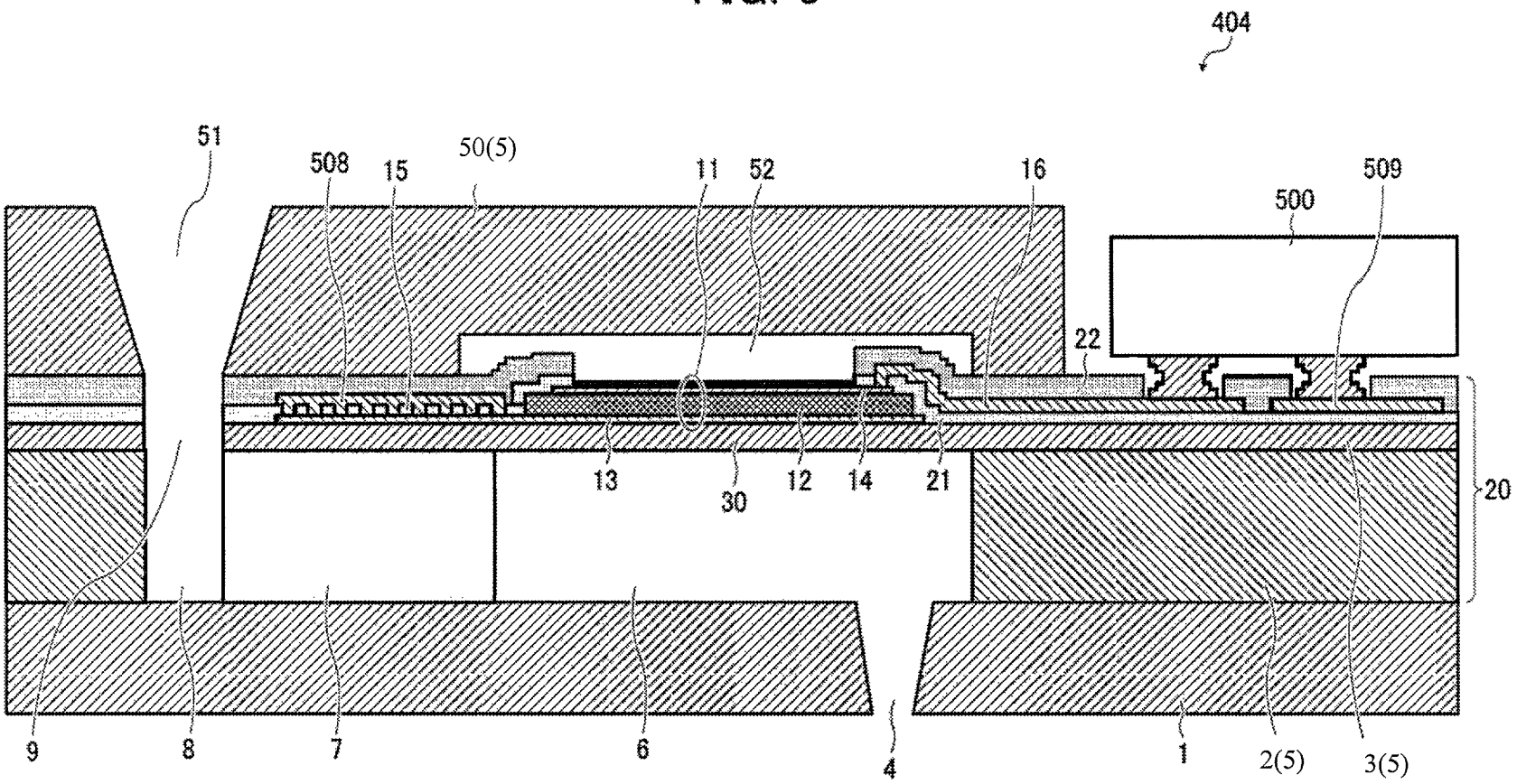
FIG. 3 is an enlarged cross-sectional view of a portion of the liquid discharge head of FIG. 2.
Figure 4:
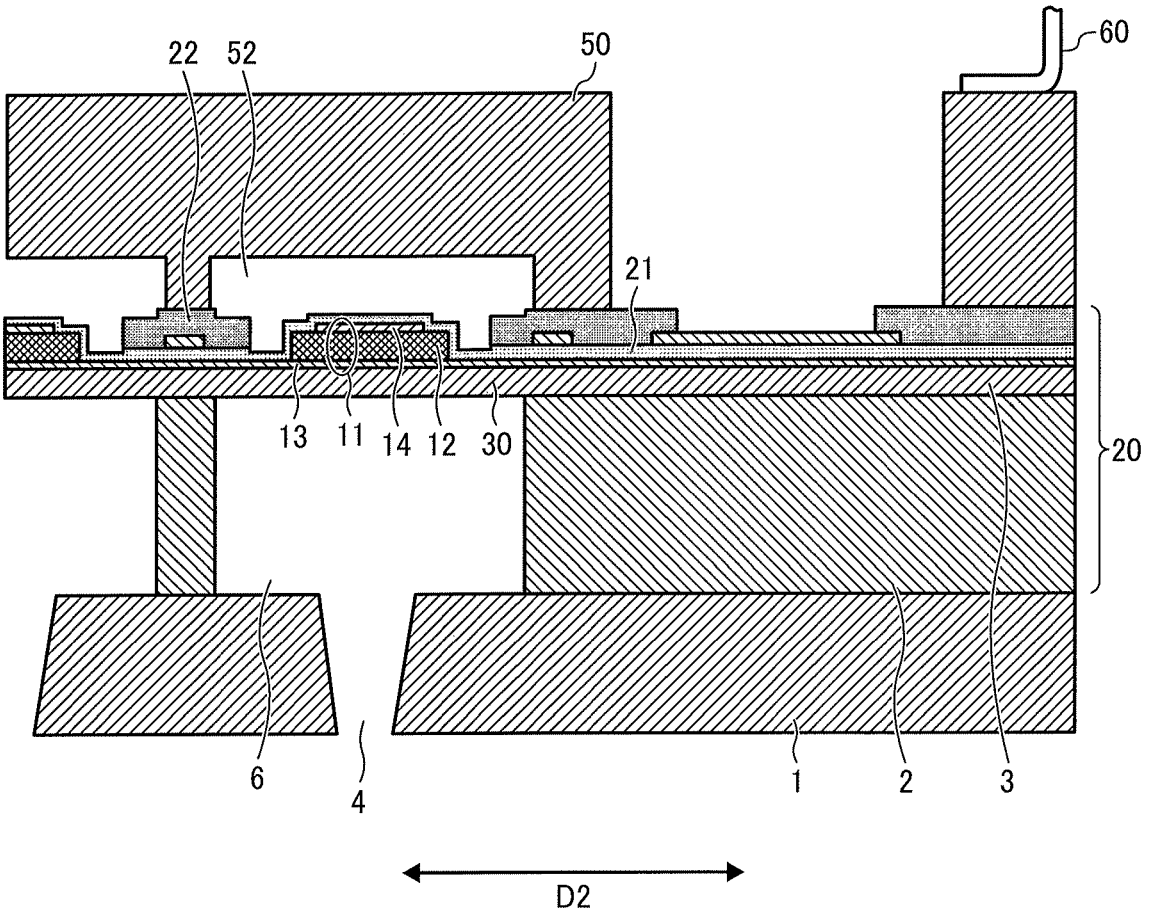
FIG. 4 is a cross-sectional view of a portion of the liquid discharge head of FIG. 2 cut along the nozzle array direction.

Referring now to the drawings, wherein like reference numerals designate identical or corresponding parts throughout the several views, embodiments of the present disclosure are described below. A general configuration of a liquid discharge head according to an embodiment of the present disclosure is described with reference to FIGS. 1 to 4. FIG. 1 is an exploded perspective view of the liquid discharge head according to an embodiment of the present disclosure. FIG. 2 is a cross-sectional view of the liquid discharge head of FIG. 1 cut along a direction perpendicular to a nozzle array direction in which nozzles are arrayed in row. FIG. 3 is an enlarged cross-sectional view of a portion of the liquid discharge head of FIG. 2. FIG. 4 is a cross-sectional view of a portion of the liquid discharge head of FIG. 2 cut along the nozzle array direction.

A liquid discharge head 404 according to the present embodiment includes a nozzle plate 1, a channel plate 2, a diaphragm plate 3 as a wall member, piezoelectric elements 11 as pressure generating elements (pressure generators), a holding substrate 50, a wiring member 60 such as a flexible printed circuit (FPC), and a frame substrate 70. The frame substrate 70 is also a common-liquid-chamber substrate.

The channel plate 2, the diaphragm plate 3, and the piezoelectric element 11 form an actuator board 20 according to the present embodiment. Note that the actuator substrate 20 does not include the nozzle plate 1 or the holding substrate 50 that is bonded to the actuator substrate 20 after the actuator substrate 20 is formed as an independent component. The channel plate 2, the diaphragm plate 3, and the holding substrate 50 form a channel substrate 5.

The nozzle plate 1 includes a plurality of nozzles 4 to discharge liquid. In the present embodiment, the nozzles 4 are arrayed in four rows.

With the nozzle plate 1 and the diaphragm plate 3, the channel plate 2 forms individual liquid chambers 6 communicated with the nozzles 4, fluid restrictors 7 communicated with the individual liquid chambers 6, and liquid inlets (passages) 8 communicated with the fluid restrictors 7.

The liquid inlets 8 are communicated with common liquid chambers 10 in the frame substrate 70 via passages (supply ports) 9 of the diaphragm plate 3 and openings 51 as channels of the holding board 50.

The diaphragm plate 3 includes deformable vibration portions 30 forming part of walls of the individual liquid chambers 6. The piezoelectric element 11 is disposed integrally with the vibration portion 30 on a face of the vibration portion 30 opposite the individual liquid chamber 6. The vibration portion 30 and the piezoelectric element 11 form a piezoelectric actuator.

In the piezoelectric element 11, a lower electrode 13, a piezoelectric layer (piezoelectric body) 12, and an upper electrode 14 are laminated in this order from the vibration portion 30. An insulation film 21 is disposed on the piezoelectric element 11.

The lower electrode 13 as a common electrode for the plurality of piezoelectric elements 11 is connected to a common-electrode power-supply wiring pattern 508 via a common wire 15. Note that, as illustrated in FIG. 4, the lower electrode 13 is a single electrode layer straddling all of the piezoelectric elements 11 in a nozzle array direction indicated by arrow D2.

The upper electrodes 14 as discrete electrodes for the piezoelectric elements 11 are connected to a drive integrated circuit (IC) 500 (hereinafter, driver IC 500) as a drive circuit via individual wires 16. The individual wire 16 is covered with an insulation film 22.

The driver IC 500 is mounted on the actuator board 20 by, e.g., a flip-chip bonding method, to cover an area between rows of the piezoelectric elements 11.

The driver IC 500 mounted on the actuator substrate 20 is connected to a discrete-electrode power-supply wiring pattern 509 to which a drive waveform (drive signal) is supplied.

At one end of the wiring member 60, a wire is electrically connected to the driver IC 500. The opposite end of the wiring member 60 is connected to a controller mounted to an apparatus body.

The holding substrate 50 covering the piezoelectric element 11 on the actuator substrate 20 is bonded, with adhesive, to one side of the actuator substrate 20 in which the diaphragm plate 3 is disposed.

The holding substrate 50 has the openings 51 being slit-shaped through holes communicating the common liquid chamber 10 with the individual liquid chambers 6 and extending along the nozzle array direction D2. The holding substrate 50 includes recessed portions 52 to accommodate the piezoelectric elements 11 and openings 53 to accommodate the driver ICs 500. Note that, as the openings 51, the holding substrate 50 may have a plurality of openings corresponding to one individual liquid chamber or a plurality of individual liquid chambers.

The holding substrate 50 is interposed between the actuator substrate 20 and the frame substrate 70 as the common-liquid-chamber substrate and constitutes part of a wall of the common liquid chamber 10.

The frame substrate 70 is the common-liquid-chamber substrate including the common liquid chambers 10 to supply liquid to the individual liquid chambers 6. Note that, in the present embodiment, the four common liquid chambers 10 are disposed corresponding to the four nozzle rows. Desired colors of liquids are supplied to the respective common liquid chambers 10 via liquid supply ports 71 (see FIG. 1).

A damper unit 90 is bonded to the frame substrate 70. The damper unit 90 includes a damper 91 and damper plates 92. The damper 91 is deformable and forms part of wall faces of the common liquid chambers 10. The damper plates 92 reinforce the damper 91.

The frame substrate 70 is bonded to the holding substrate 50 and an outer peripheral portion of the nozzle plate 1 with adhesive, to accommodate the actuator substrate 20 and the holding substrate 50, thus forming a frame of the liquid discharge heads 404.

Nozzle covers 45 are disposed to cover part of a peripheral area of the nozzle plate 1 and part of outer circumferential faces of the frame substrate 70.

In the liquid discharge head 404, voltage is applied from the driver IC 500 to a portion between the upper electrode 14 and the lower electrode 13 of the piezoelectric element 11. Accordingly, the piezoelectric layer 12 expands in an electrode lamination direction (in other words, an electric-field direction) in which the upper electrode 14 and the lower electrode 13 are laminated, and contracts in a direction parallel to the vibration portion 30. Thus, tensile stress arises at a side (hereinafter, lower electrode 13 side) of the vibration portion 30 facing the lower electrode 13, causing the vibration portion 30 to bend toward a side (hereinafter, individual liquid chamber 6 side) of the vibration portion 30 facing the individual liquid chamber 6. Accordingly, liquid within the individual liquid chamber 6 is pressurized and discharged from the nozzle 4.

Figure 5A:
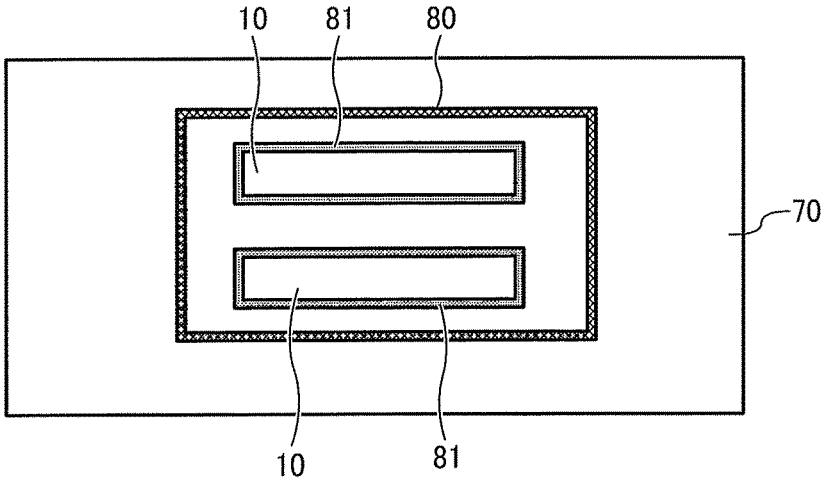
FIGS. 5A to 5C are plan views of bonding areas of an adhesive and sealing areas of a sealant in a first embodiment of the present disclosure.
Figure 5B:
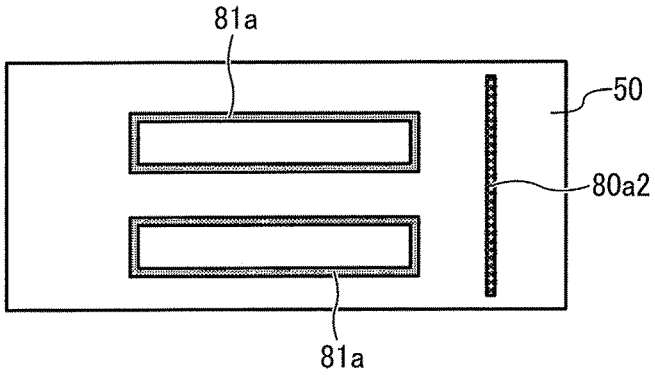
Figure 5C:
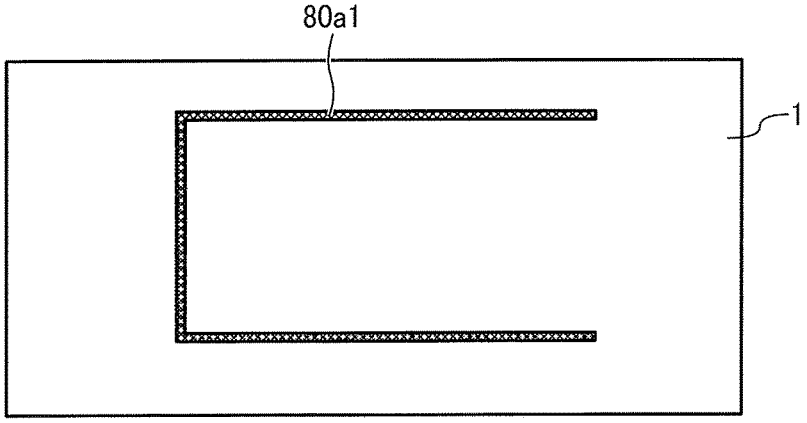

Next, an outline of bonding areas with an adhesive and a sealing area with a sealant in a first embodiment of the present disclosure is described with reference to FIGS. 5A to 5C. FIGS. 5A to 5C are plan views of the bonding areas and the sealing area in the first embodiment. Note that, in FIGS. 5A to 5C, two common liquid chambers are illustrated for simplification.

FIG. 5A is a plan view of areas (bonding areas) of an adhesive 81 being an adhesive applied to the frame substrate 70, and an area (sealing area) of a sealant 80. FIG. 5B is a plan view of bonding areas 81*a* of the adhesive 81 and a sealing area 80*a*2 of the sealant 80 on the holding substrate 50. FIG. 5C is a plan view of a sealing area 80*a*1 of the sealant 80 on the nozzle plate 1.

In the present embodiment, as illustrated in FIG. 5A, the adhesive 81 is applied to the frame substrate 70 so as to surround the two common liquid chambers 10. As illustrated in FIG. 5B, the adhesive 81 applied to the frame substrate 70 is bonded to the bonding areas 81*a* of the holding substrate 50.

The sealant 80 is disposed surrounding the adhesive 81 so as to include areas surrounded by the adhesive 81. As illustrated in FIG. 5C, the sealant 80 is disposed between the sealing area 80*a*1 of the nozzle plate 1 and three sides around the adhesive 81 of the frame substrate 70. The sealant 80 is also disposed between the sealing area 80*a*2 of the sealant 80 in the holding substrate 50 and the remaining one side around the adhesive 81 of the frame substrate 70.

Accordingly, in plan view, the sealant 80 is disposed surrounding the adhesive 81 facing the common liquid chamber 10. In other words, the frame substrate 70 (as common-liquid-chamber substrate) is bonded to the holding substrate 50, which constitutes part of the channel substrate 5, with the adhesive 81 facing liquid flow channels (the common liquid chambers 10 including the openings 51). The sealant 80 is disposed surrounding the adhesive 81 at an opposite side of the liquid flow channels relative to the adhesive 81.

Here, the sealant 80 is disposed surrounding the adhesive 81 so as to include the areas surrounded by the adhesive 81 in plan view. Note that the term "plan view" indicates a state in which the nozzle plate 1, the actuator substrate 20, and the holding substrate 50 are transparently seen from above the nozzle plate 1 of the liquid discharge head 404.

As described above, even when a permeable adhesive is used as the adhesive 81, the sealant 80 surrounding the adhesive 81 around the common liquid chamber 10 can reduce evaporation of moisture through the adhesive 81, thus reducing thickening liquid. Accordingly, stable discharging performance can be maintained, thus reducing discharge failure. In addition, a greater degree of freedom can be set in selecting a material of the adhesive 81.

For example, in a typical liquid discharge head, generally, an adhesive having good resistance to water and solvent and low permeability is selected and used for the bonding of a portion in which a channel is formed.

However, for the configuration as illustrated in FIG. 2 in which the common-liquid-chamber substrate is bonded to the holding substrate 50 (constituting part of the channel substrate 5) bonded to the actuator substrate), when a pressure generating element of the actuator substrate is driven, vibration of the holding substrate may propagate to the common liquid chamber, thus resulting in unstable discharge properties.

To prevent such a failure, it might be effective to absorb vibration by bonding the holding substrate to the common-liquid-chamber substrate with an elastic adhesive. However, such an elastic adhesive is likely to have a high degree of permeability in molecular structure. Accordingly, moisture is likely to evaporate through the elastic adhesive from liquid flowing through a channel and cause thickening of liquid in the channel, thus causing discharge failure.

Hence, in the present embodiment, the adhesive 81 around the common liquid chambers 10 is surrounded by the sealant 80. Such a configuration increases the humidity in an area between the sealant 80 and the adhesive 81 inside the sealant 80, thus reducing evaporation of moisture of liquid in the channels.

The humidity of an inner area of the sealant 80 is preferably at a saturation vapor pressure at an environmental temperature.

Accordingly, an elastic adhesive can be used as the adhesive 81 to bond the common-liquid-chamber substrate (the frame substrate 70) to the holding substrate 50. The vibration of the holding substrate 50 is absorbed and damped. Such a configuration can reduce the propagation of the vibration of the holding substrate 50 to the common-liquid-chamber substrate (the frame substrate 70), thus reducing instability of discharge properties.

In such a case, in a direction perpendicular to the surface, the sealant 80 is disposed between the nozzle plate 1 and the frame substrate 70 and between the holding substrate 50 and the frame substrate 70. At least a portion of the sealant 80 is disposed at a position differing in height from another portion of the sealant 80, to three-dimensionally seal the liquid discharge head 404. Note that the direction perpendicular to the surface represents a direction perpendicular to the surface of the liquid discharge head 404 (the surface in which the nozzles 4 are formed) and the same direction as a direction of lamination of the nozzle plate 1, the actuator substrate 20, the holding substrate 50, and the common liquid chamber 10.

In the above description, the adhesive 81 is disposed surrounding each of the two common liquid chambers 10, and there are a plurality of areas surrounded by the adhesive 81. The sealant 80 is disposed collectively surrounding the plurality of areas, in each of which the common liquid chamber 10 is surrounded by the adhesive 81.

Figure 6:
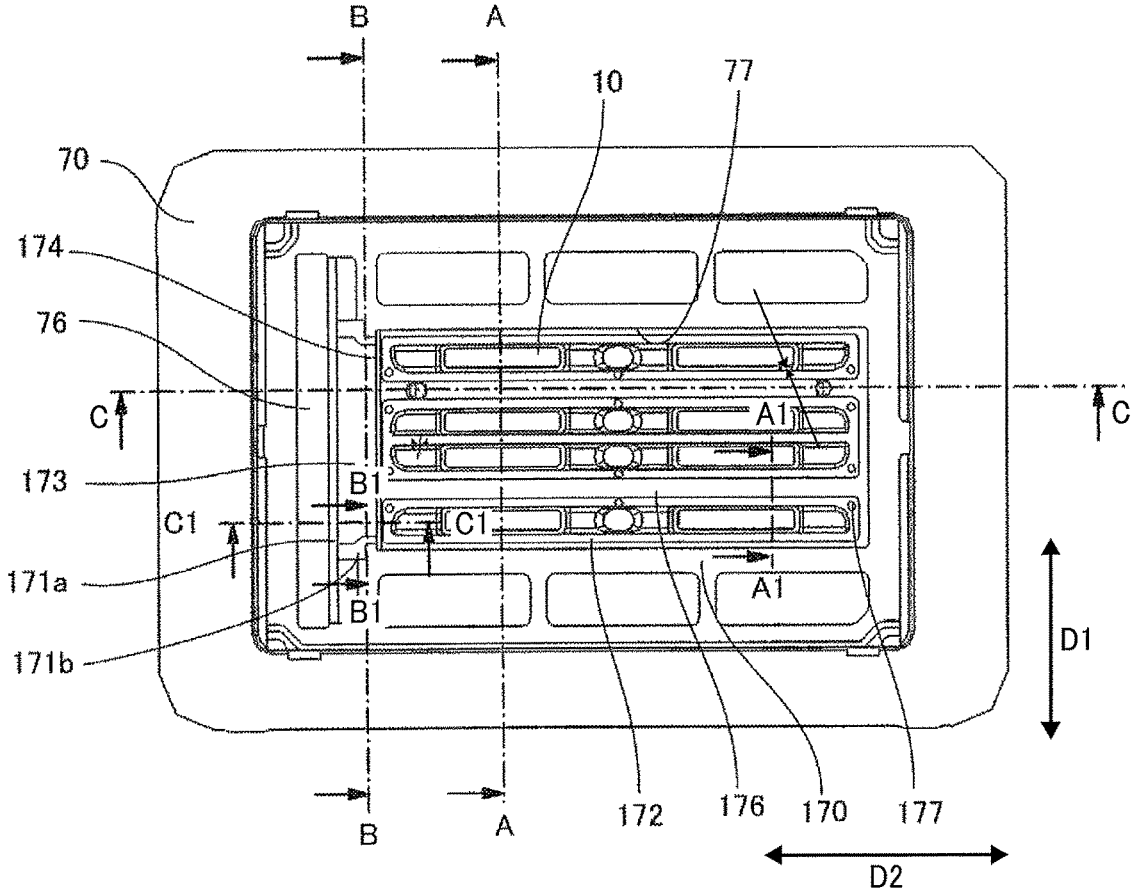
FIG. 6 is a plan view of a frame substrate as a common-liquid-chamber substrate in the first embodiment.
Figure 7:
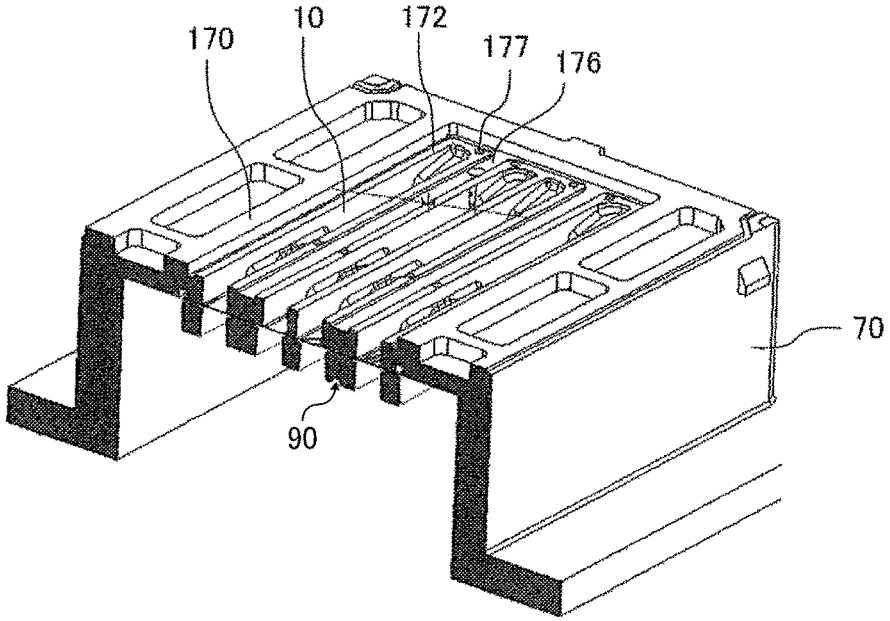
FIG. 7 is a cross-sectional perspective view of the frame substrate cut along line A-A of FIG. 6.
Figure 8:
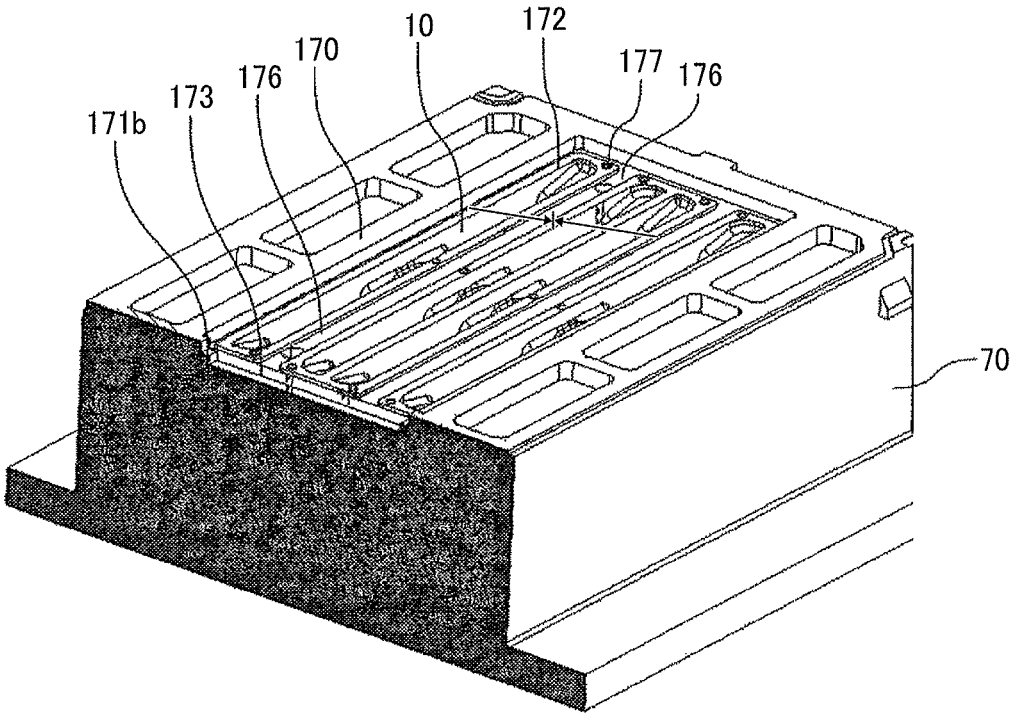
FIG. 8 is a cross-sectional perspective view of the frame substrate cut along line B-B of FIG. 6.
Figure 9A:
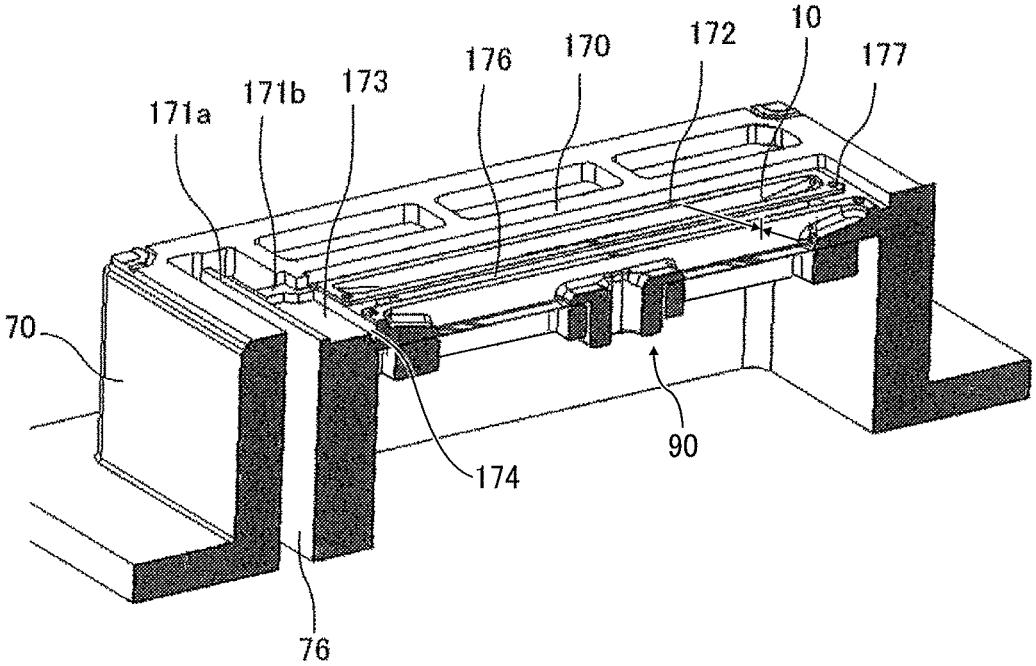
FIG. 9A is a cross-sectional perspective view of the frame substrate cut along line C-C of FIG. 6.
Figure 9B:
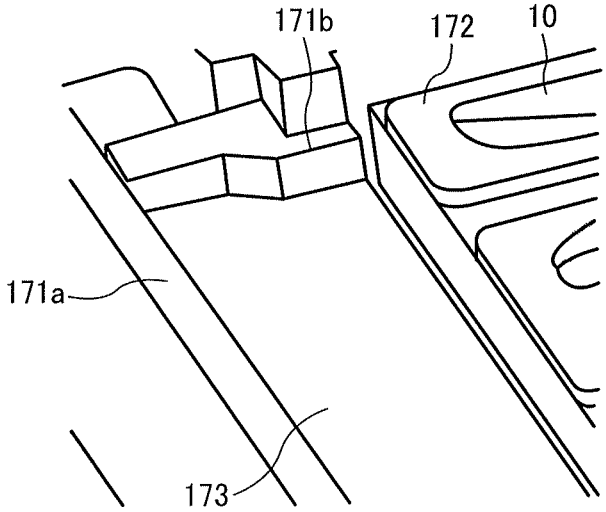
FIG. 9B is an enlarged perspective view of a portion of the frame substrate of FIG. 9A.
Figure 10:
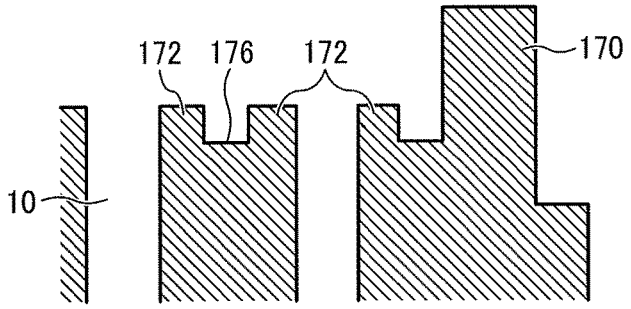
FIG. 10 is an illustration of a rib portion cut along line A1-A1 of FIG. 6.
Figure 11:
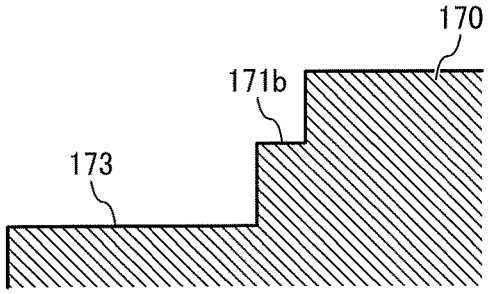
FIG. 11 is a cross-sectional view of the rib portion cut along line B1-B1 of FIG. 6.
Figure 12:
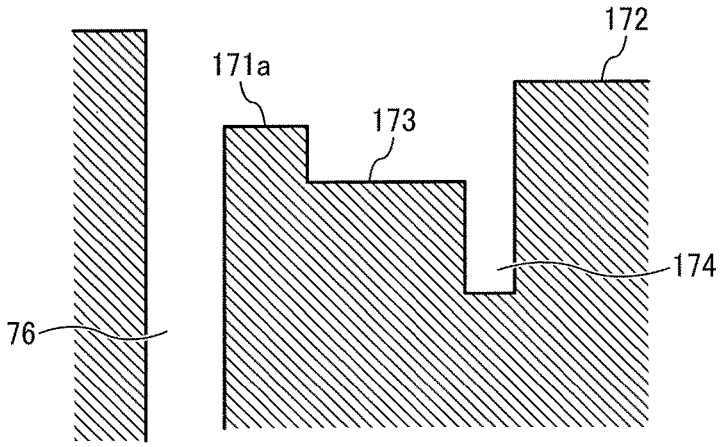
FIG. 12 is a cross-sectional view of the rib portion cut along line C1-C1 of FIG. 6.

Next, the frame substrate as the common-liquid-chamber substrate in the present embodiment is described with reference to FIG. 6 through FIG. 12. FIG. 6 is a plan view of the frame substrate. FIG. 7 is a cross-sectional perspective view of the frame substrate cut along line A-A of FIG. 6. FIG. 8 is a cross-sectional perspective view of the frame substrate cut along line B-B of FIG. 6. FIG. 9A is a cross-sectional perspective view of the frame substrate cut along line C-C of FIG. 6. FIG. 9B is an enlarged perspective view of a portion of the frame substrate of FIG. 9A. FIG. 10 is an illustration of a rib portion cut along line A1-A1 of FIG. 6. FIG. 11 is a cross-sectional view of the rib portion cut along line B1-B1 of FIG. 6. FIG. 12 is a cross-sectional view of the rib portion cut along line C1-C1 of FIG. 6. Note that the frame substrate is illustrated in a state in which a damper unit is bonded to the frame substrate.

Note that, in the present embodiment, an example is described in which a sealing agent (e.g., epoxy adhesive) is used as the sealant.

As illustrated in FIG. 10, in the frame substrate 70 as the common-liquid-chamber substrate, ribs 172 as first ribs forming a bonding surface bonded to the holding substrate 50 are disposed around the respective common liquid chambers 10. In such a case, in an area between adjacent ones of the common liquid chambers 10, a step portion 176 is disposed between adjacent ones of the ribs 172. A plurality of projections 177 is disposed on each rib 172.

As illustrated in FIG. 10, the frame substrate 70 has a rib 170 as a second rib forming a bonding surface bonded to the nozzle plate 1 is disposed surrounding three sides of all of the common liquid chambers 10. In the present embodiment, at the rib 170, the sealing agent is interposed between the frame substrate 70 and the nozzle plate 1. The rib 170 is disposed surrounding opposed sides extending along a longitudinal direction of the common liquid chamber 10 and one of opposed sides extending along a short direction of the common liquid chamber 10. A port 76 through which the wiring member 60 passes is disposed at a longitudinal end of the frame substrate 70.

In the present embodiment, in the direction perpendicular to the surface (the direction of lamination of the nozzle plate 1, the holding substrate 50, and the frame substrate 70 (the common-liquid-chamber substrate)), the ribs 172 as the first ribs forming are disposed at a different position in height from the rib 170 as the second rib. In other words, the rib 170 as the second rib is disposed at a position higher than the ribs 172 as the first ribs.

As illustrated in FIGS. 11 and 12, a sealing-agent application groove 173 being a recessed portion is disposed between the port 76 and the common liquid chambers 10. Three sides of the sealing-agent application groove 173 are surrounded by a rib 171*a* and ribs 171*b*. The ribs 171*b* are disposed at opposed ends of the sealing-agent application groove 173 in a direction D1 perpendicular to the nozzle array direction D2. As illustrated in FIG. 11, the ribs 171*b* constitute step portions between the bonding surface of the rib 170 and the ribs 171*b*.

As illustrated in FIG. 12, a sealing-agent escape groove 174 is disposed between the sealing-agent application groove 173 and the ribs 172.

Figure 13:
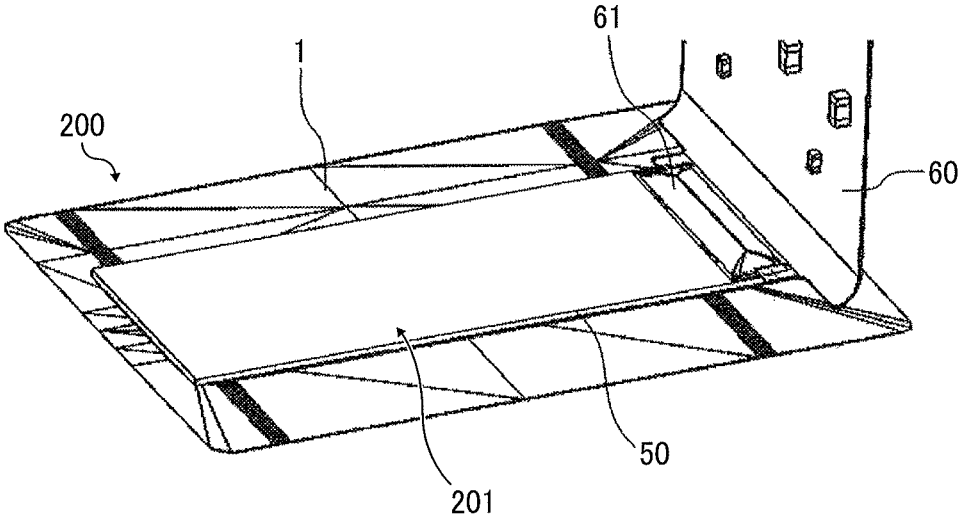
FIG. 13 is a perspective view of a connecting portion of the wiring member and each of an actuator substrate and a holding substrate.
Figure 14:
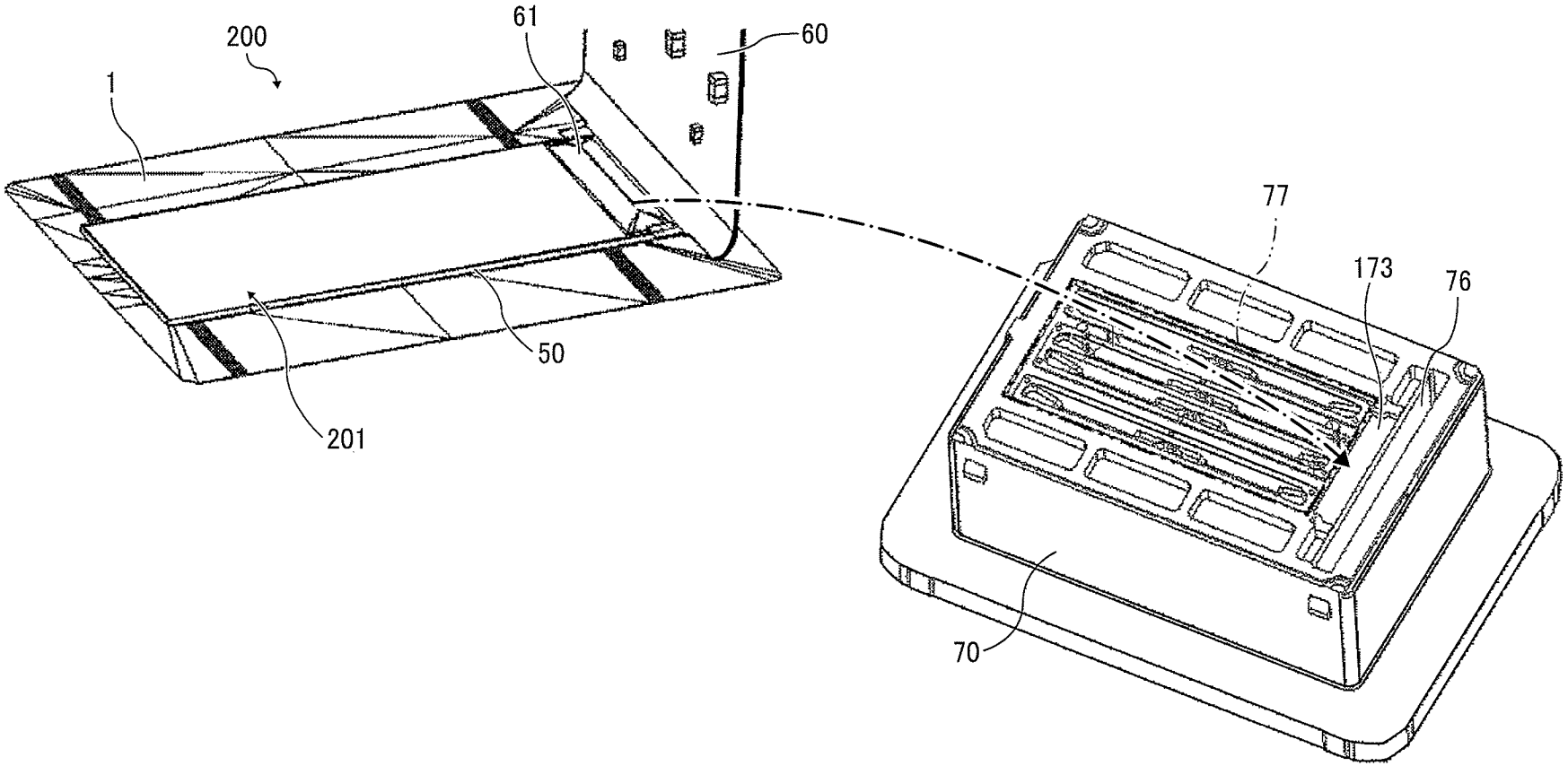
FIG. 14 is a perspective view of bonding of the connecting portion to the frame substrate.

Next, a connecting portion of the wiring member to the actuator substrate and the holding substrate is described with reference to FIG. 13 and FIG. 14. FIG. 13 is a perspective view of the connecting portion. FIG. 14 is a perspective view of bonding of the connecting portion to the frame substrate.

Note that, in the following description, a combination of the actuator substrate 20 and the holding substrate 50 is referred to as "actuator unit 201". However, the actuator unit 201 is not limited to a single molded unit and the actuator substrate 20 and the holding substrate 50 may be separate members. In addition, a combination of the actuator unit 201, the nozzle plate 1, and the wiring member 60 is referred to as "structural body 200".

The wiring member 60 is attached to one end of the actuator unit 201 in a longitudinal direction (nozzle array direction D2) of the actuator unit 201. A resin member 61 being an intermediate member is molded at a portion at which the wiring member 60 is attached to the actuator unit 201. For example, the wiring member 60 is attached to one end of the holding substrate 50 in a longitudinal direction of the holding substrate 50. The resin member 61 being an intermediate member is molded at a portion at which the wiring member 60 is attached to the holding substrate 50. Note that the intermediate member is a member interposed between the frame substrate 70 as the common-liquid-chamber substrate and the holding substrate 50.

When the structural body 200 connected to the wiring member 60 is attached to the frame substrate 70, the resin member 61 is fit into the sealing-agent application groove 173 of the frame substrate 70.

Figure 15:
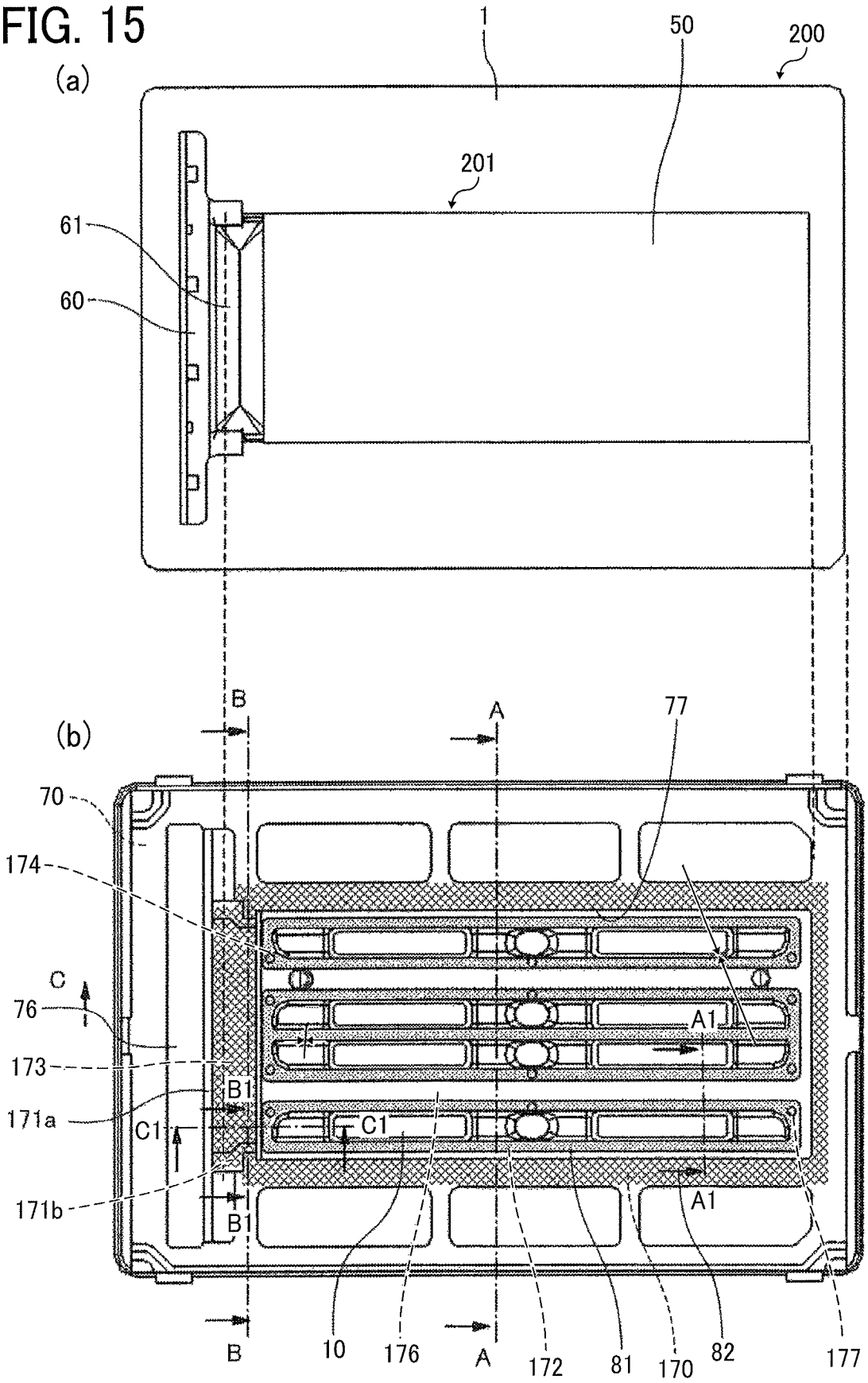
FIG. 15 is a plan view of the frame substrate and a structural body seen from a bonding surface side.
Figure 16:
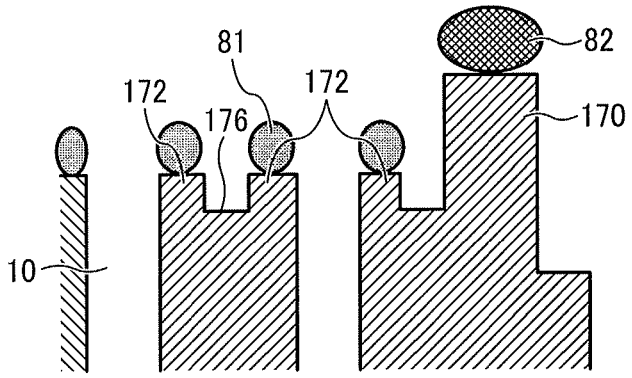
FIG. 16 is an illustration of the rib portion cut along line A1-A1 of FIG. 15.
Figure 17:
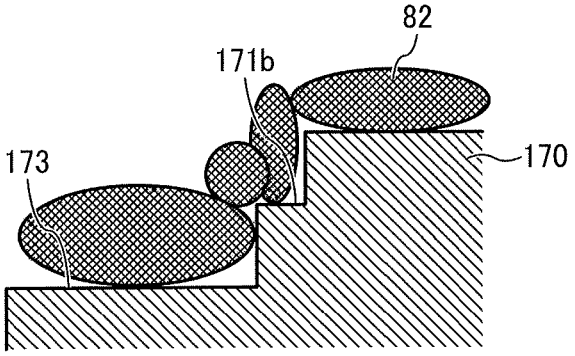
FIG. 17 is a cross-sectional view of the rib portion cut along line B1-B1 of FIG. 15.
Figure 18:
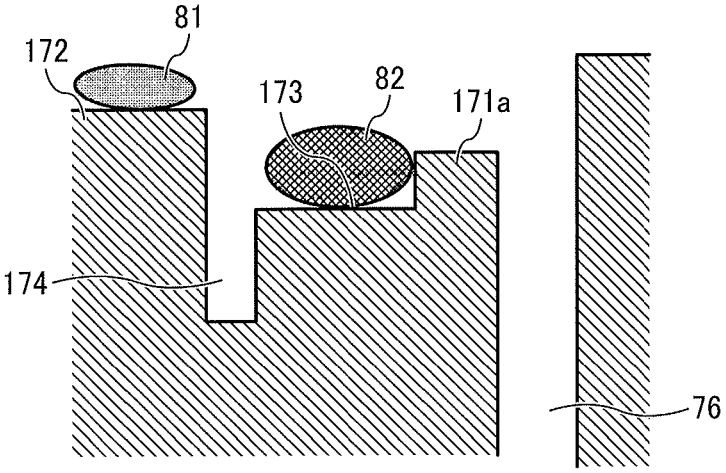
FIG. 18 is a cross-sectional view of the rib portion cut along line C1-C1 of FIG. 15.

Next, application areas of the adhesive of the frame substrate and application areas of the sealing agent are described with reference to FIGS. 15 through 18. FIG. 15 is a plan view of the frame substrate and the structural body seen from the bonding surface side. FIG. 16 is an illustration of the rib portion cut along line A1-A1 of FIG. 15. FIG. 17 is a cross-sectional view of the rib portion cut along line B1-B1 of FIG. 15. FIG. 18 is a cross-sectional view of the rib portion cut along line C1-C1 of FIG. 15.

The ribs 172 are disposed around the respective common liquid chambers 10. The adhesive 81 is applied to the bonding surfaces of the ribs 172 to be bonded to the holding substrate 50. The adhesive 81 surrounds each of the common liquid chambers 10 in an endless state without interruption.

Note that the adhesive is an adhesive that turns to be a rubber body after curing. For example, a silicone-based adhesive may be used as the adhesive. In some embodiments, urethane or biomass-based adhesive may be used. As an adhesive allowing more effective absorption of vibration, for example, the adhesive is preferably a modulus of elasticity of several tens MPa or lower.

A sealing agent 82 is applied to the bonding surface of the rib 170 of the frame substrate 70, which is bonded to the nozzle plate 1. The sealing agent 82 is applied in a U shape in plan view to surround the outside of the application areas of the adhesive 81. In such a case, the sealing agent 82 is disposed collectively surrounding the four areas surrounded by the adhesive 81.

The sealing agent 82 is applied to the sealing-agent application groove 173 and the ribs 171*b*, to which the resin member 61 of the frame substrate 70 fits.

The sealing agent 82 applied to the sealing-agent application groove 173 and the ribs 171*b* and the sealing agent 82 applied to the rib 170 of the frame substrate 70 in the U shape surround an outside of the adhesive 81 including the areas surrounded by the adhesive 81 in an endless state without interruption in plan view.

Similarly with the above-described epoxy adhesive, the sealing agent 82 also preferably has a high modulus of elasticity and a low permeability. For example, the modulus of elasticity is preferably several GPa or higher. When a heat curing adhesive is used as the sealing agent 8, the sealing agent 82 can preferably be cured simultaneously with the adhesive 81.

When the permeability of the adhesive 81 is 100 to 1000 $cc/m^2 \cdot 24$ h (unit indicating an amount (cc) of moisture that permeates an area of 1 $m^2$ of a material per 24 hours), for example, a material having a permeability of 0 to 10 $cc/m^2 \cdot 24$ h can be used for the sealing agent 82.

Figure 19:
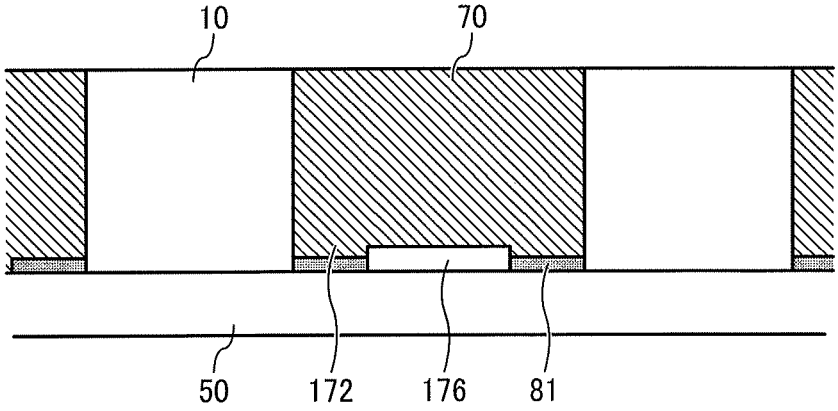
FIG. 19 is a cross-sectional view of bonding portions around common liquid chambers of the frame substrate in a bonded state in which the frame substrate and the structural body are bonded together.
Figure 20:
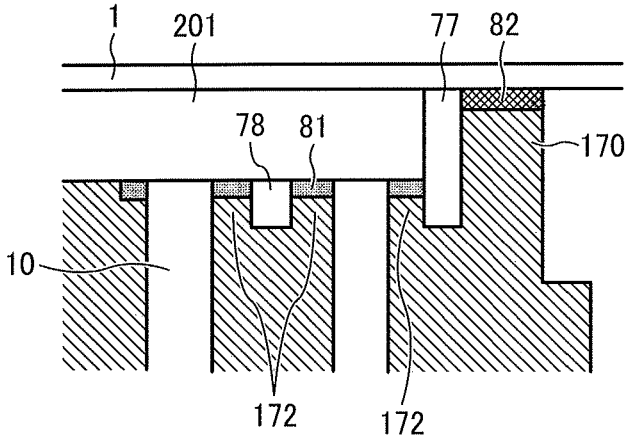
FIG. 20 is a cross-sectional view of the rib portion corresponding to FIG. 16 in the bonded state.
Figure 21:
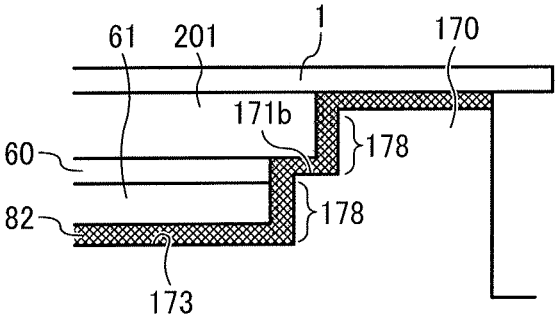
FIG. 21 is a cross-sectional view of the rib portion corresponding to FIG. 17 in the bonded state.
Figure 22:
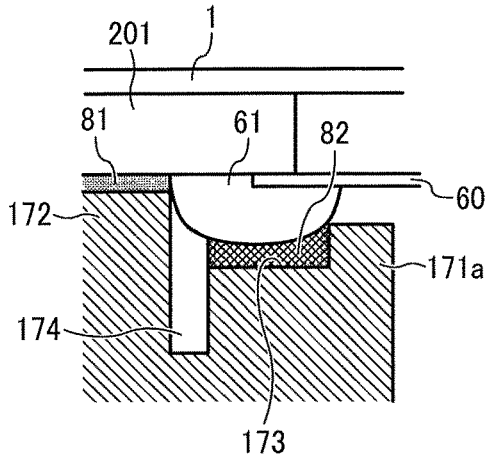
FIG. 22 is a cross-sectional view of the rib portion corresponding to FIG. 18 in the bonded state.

Next, a bonding state of the frame substrate and the structural body is described with reference to FIGS. 19 to 22. FIG. 19 is a cross-sectional view of bonding portions around the common liquid chambers of the frame substrate in a bonded state in which the frame substrate and the structural body are bonded together. FIG. 20 is a cross-sectional view of the rib portion corresponding to FIG. 16 in the bonded state. FIG. 21 is a cross-sectional view of the rib portion corresponding to FIG. 17 in the bonded state. FIG. 22 is a cross-sectional view of the rib portion corresponding to FIG. 18 in the bonded state.

As described above, the adhesive 81 and the sealing agent 82 are applied to the frame substrate 70, and the structural body 200 is bonded to the frame substrate 70. For example, by heating the adhesive 81 and the sealing agent 82 to cure the adhesive 81 and the sealing agent 82, as illustrated in FIGS. 19 to 22, respective components, such as the frame substrate 70 and the structural body 200, are bonded together with the adhesive 81 or the sealing agent 82.

In the present embodiment, as illustrated in FIG. 19, the adhesive 81 around the common liquid chamber 10 to bond the frame substrate 70 to the holding substrate 50 partially faces the common liquid chamber 10.

Such a configuration allows damping of pressure waves propagated through the openings 51.

In the liquid discharge head 404 according to the present embodiment, the frame substrate 70 as the common-liquid-chamber substrate includes the rib 170 constituting an accommodation space 77 to accommodate the actuator unit 201 (the actuator substrate 20 and the holding substrate 50) (see FIG. 6, FIG. 14, and FIG. 20).

The rib 170 constituting the accommodation space 77 is not disposed at a side of the accommodation space 77 from which the wiring member 60 is led out, to lead out the wiring member 60 disposed at the longitudinal end of the holding substrate 50 from the port 76 of the frame substrate 70 in the state in which the actuator unit 201 is bonded to the frame substrate 70.

Accordingly, the application areas (the rib 170, the ribs 171*b*, and the sealing-agent application groove 173) of the sealing agent 82 include stepped portions in the direction perpendicular to the surface (see FIG. 9A and FIG. 15).

The rib 170 and the ribs 171*b* are bonded to the nozzle plate 1 with the sealing agent 82. The sealing-agent application groove 173 and the resin member 61 molding the wiring member 60 are bonded together with the sealing agent 82 (se FIG. 21 and FIG. 22).

As described above, in plan view, the sealing agent 82 is disposed surrounding the adhesive 81 so as to include the areas surrounded by the adhesive 81. Such a configuration can reduce thickening of liquid due to permeability of the adhesive 81, thus reducing discharge failure due to use of the adhesive 81.

The nozzle plate 1 is bonded to the frame substrate 70 with the sealing agent 82 having a higher modulus of elasticity than the adhesive 81, in an outer area than the bonded area in which the holding substrate 50 and the frame substrate 70 are bonded together with the adhesive 81.

Accordingly, the outer circumference of the nozzle plate 1 is robustly bonded to the frame substrate 70, thus reducing deformation of the nozzle plate 1 and discharge failure.

Figure 23:
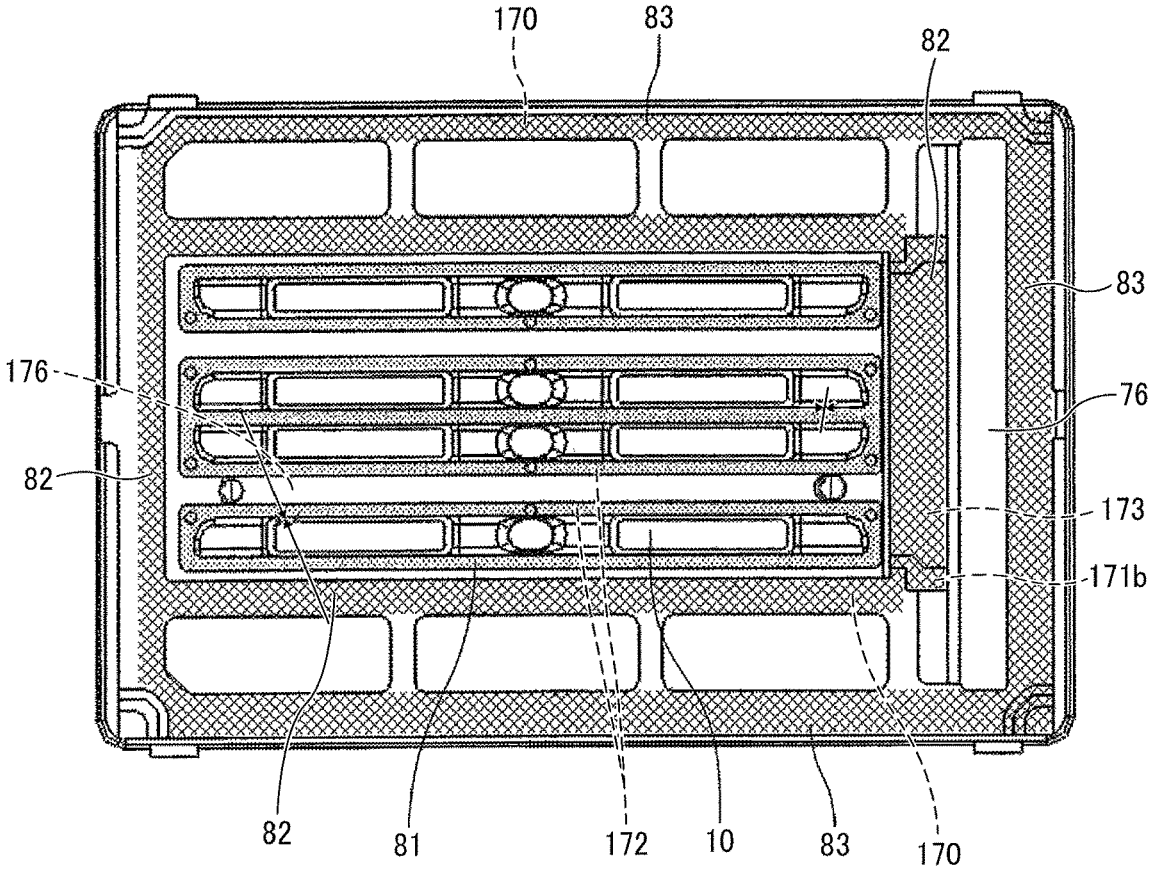
FIG. 23 is a plan view of application areas of the adhesive of the frame substrate and application areas of a sealing agent in a second embodiment of the present disclosure.

Next, a second embodiment of this disclosure is described with reference to FIG. 23. FIG. 23 is a plan view of the application areas of the adhesive of the frame substrate and the application areas of the sealing agent in the second embodiment.

Note that, in the present embodiment as well, an example is described in which a sealing agent (e.g., epoxy adhesive) is used as the sealant.

In the present embodiment, an adhesive 83 as a second adhesive is applied to an outermost peripheral area, which is also an outer area than the application areas of the sealing agent 82 on the frame substrate 70, to bond the frame substrate 70 to the nozzle plate 1. Note that the same material as the sealing agent 82 is used for the adhesive 83 to facilitate application work.

Such a configuration can reduce penetration of liquid from the outside to the inside of the liquid discharge head through a gap between the frame substrate 70 and the nozzle plate 1.

Figure 24:
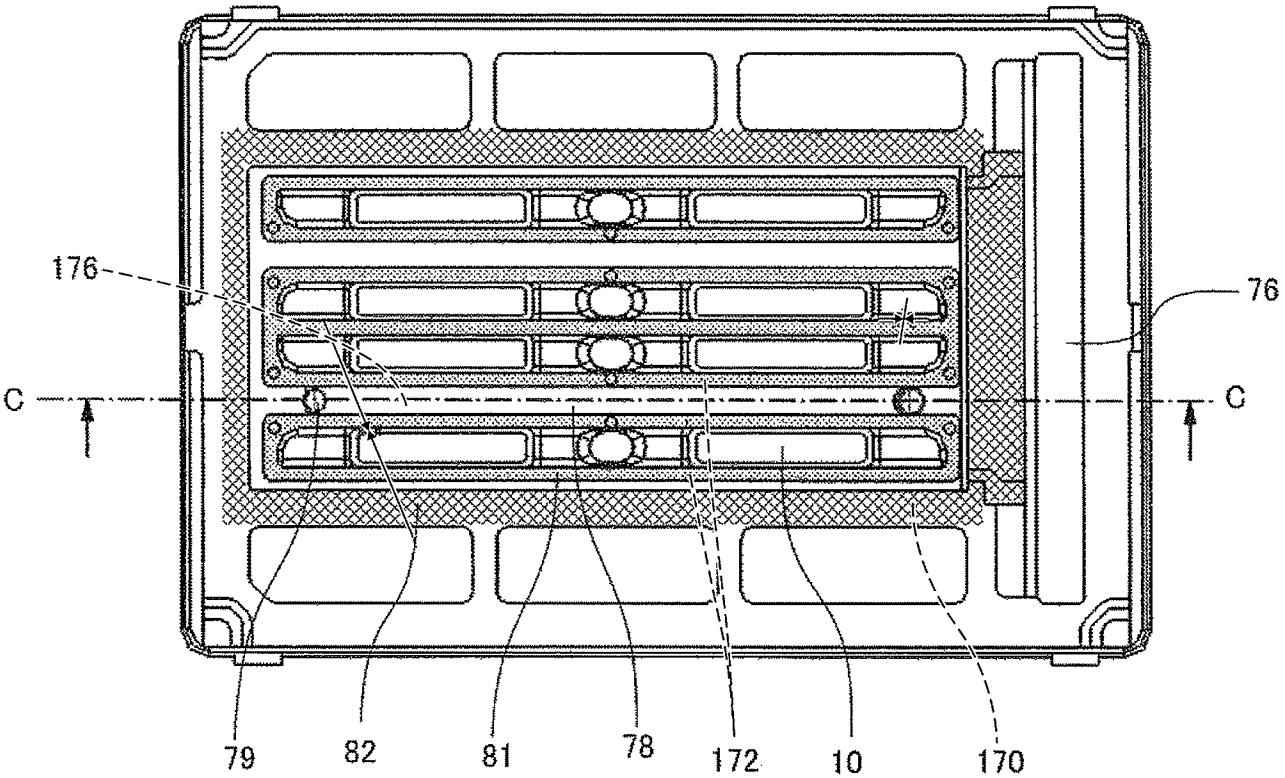
FIG. 24 is a plan view of the frame substrate in a third embodiment of the present disclosure.
Figure 25:
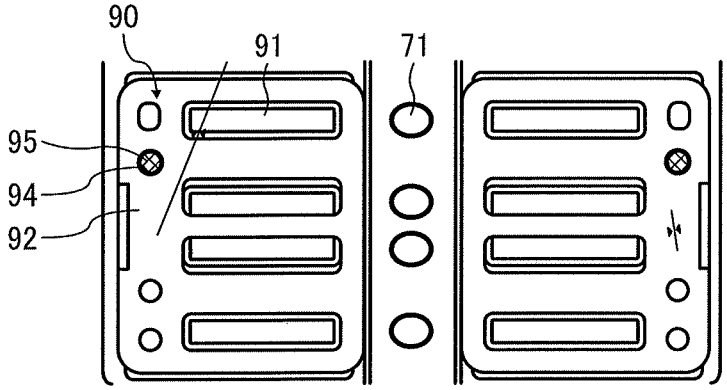
FIG. 25 is a plan view of the liquid discharge head according to the third embodiment, seen from a damper unit side.
Figure 26:
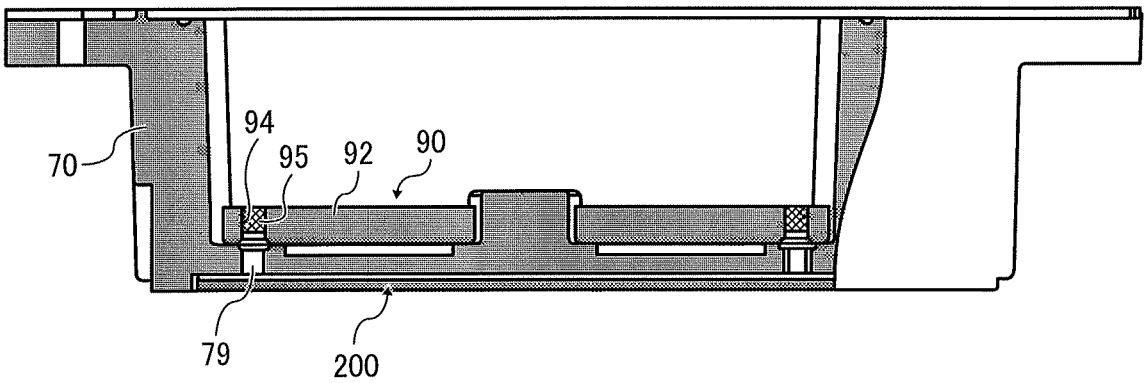
FIG. 26 is a cross-sectional view of the liquid discharge head cut along line C-C of FIG. 24.

Next, a third embodiment of the present disclosure is described with reference to FIGS. 24 through 26. FIG. 24 is a plan view of the frame substrate in the third embodiment. FIG. 25 is a plan view of the liquid discharge head according to the third embodiment, seen from the damper unit side. FIG. 26 is a cross-sectional view of the liquid discharge head cut along line C-C of FIG. 24.

In the present embodiment, in a state in which the frame substrate 70 is bonded to the structural body 200, through holes 79 are disposed to communicate a space 78 (see also FIG. 20), which is formed between adjacent ribs 172 and the rib 170 at outer sides of the ribs 172 in an in-plane direction, to the outside. The through holes 79 are communicated with through holes 94 of the damper plates 92 of the damper unit 90.

Hence, the through holes 94 of the damper plates 92 are sealed with sealants (sealing members) 95 to prevent outside air from entering the space 78 through the through holes 94 and the space 78. The sealants 95 may be the same as or differ from the sealing agent 82.

Such a configuration can prevent outside air from constantly entering an outer area of the adhesive 81 through the through holes 79, which are usable for positioning or leakage inspection, thus reducing thickening of liquid in the common liquid chambers 10 due to air permeation.

Sealing of the sealants 95 is preferably performed at room temperature. In other words, if a sealed space is cured by heating, the sealant might be broken by air expansion, thus causing a path of leakage.

Hence, when the same sealing agent as the sealing agent 82 is used as the sealant 95, the sealing agent can preferably be cured both by heating and at room temperature.

The through holes 79 of the frame substrate 70 as the common-liquid-chamber substrate may be sealed with the sealant 95.

Figure 27A:
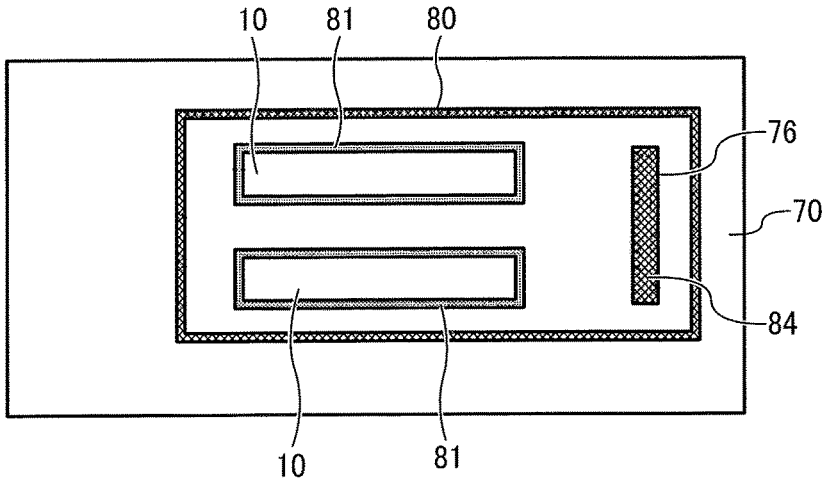
FIGS. 27A to 27C are plan views of bonding areas of the adhesive and sealing areas of the sealant in a fourth embodiment of the present disclosure.
Figure 27B:
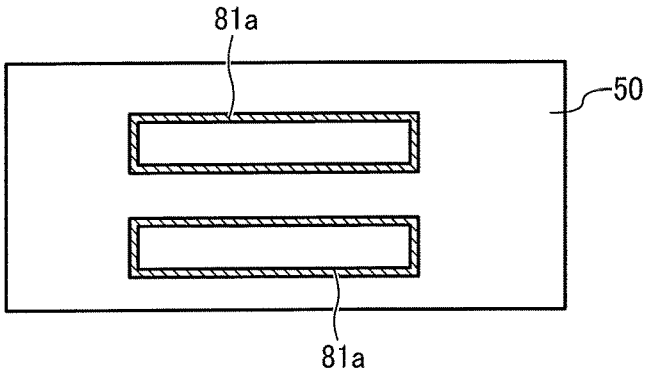
Figure 27C:
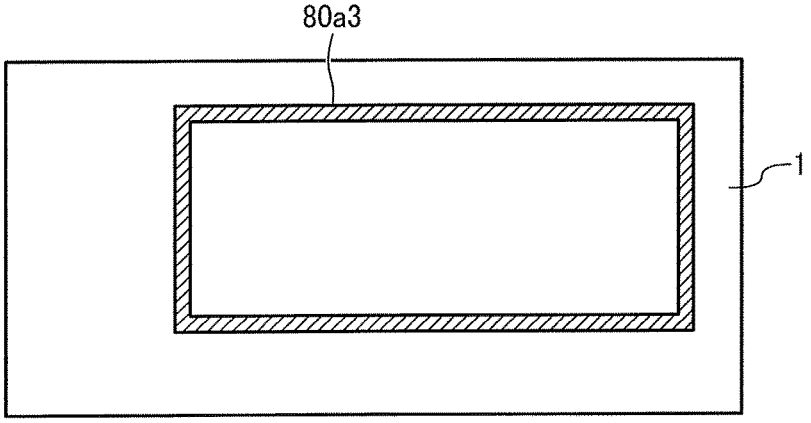

Next, a fourth embodiment of the present disclosure is described with reference to FIGS. 27A to 27C. FIGS. 27A to 27C are plan views of the bonding area of the adhesive and the sealing area of the sealant in the fourth embodiment. Note that, in FIGS. 5A to 5C, two common liquid chambers are also illustrated for simplification.

FIG. 27A is a plan view of areas (bonding areas) of an adhesive 81 being an adhesive applied to the frame substrate 70, an area (sealing area) of a sealant 80, and a sealant 84 to seal the port 76. FIG. 27B is a plan view of bonding areas 81*a* of the adhesive 81 on the holding substrate 50. FIG. 27C is a plan view of a sealing area 80*a*3 of the sealant 80 on the nozzle plate 1.

In the present embodiment, as illustrated in FIG. 27A, the adhesive 81 is applied to the frame substrate 70 so as to surround the two common liquid chambers 10. As illustrated in FIG. 27B, the adhesive 81 applied to the frame substrate 70 is bonded to the bonding areas 81*a* of the holding substrate 50.

In plan view, the sealant 80 is disposed surrounding the adhesive 81 so as to include areas surrounded by the adhesive 81. As illustrated in FIG. 27C, at four sides around the adhesive 81 of the frame substrate 70, the sealant 80 is disposed between the frame substrate 70 and the sealing area 80*a*3 of the nozzle plate 1.

Accordingly, in plan view, the sealant 80 is disposed surrounding the adhesive 81 facing the common liquid chambers 10. Here, the sealant 80 is disposed surrounding the adhesive 81 so as to include the areas surrounded by the adhesive 81. Note that the term "plan view" indicates a state in which the nozzle plate 1, the actuator substrate 20, and the holding substrate 50 are transparently seen from above the nozzle plate 1 of the liquid discharge head 404.

In the above description, the adhesive 81 is disposed surrounding each of the two common liquid chambers 10, and there is a plurality of areas surrounded by the adhesive 81. The sealant 80 is disposed collectively surrounding the plurality of areas, in each of which the common liquid chamber 10 is surrounded by the adhesive 81.

Figure 28:
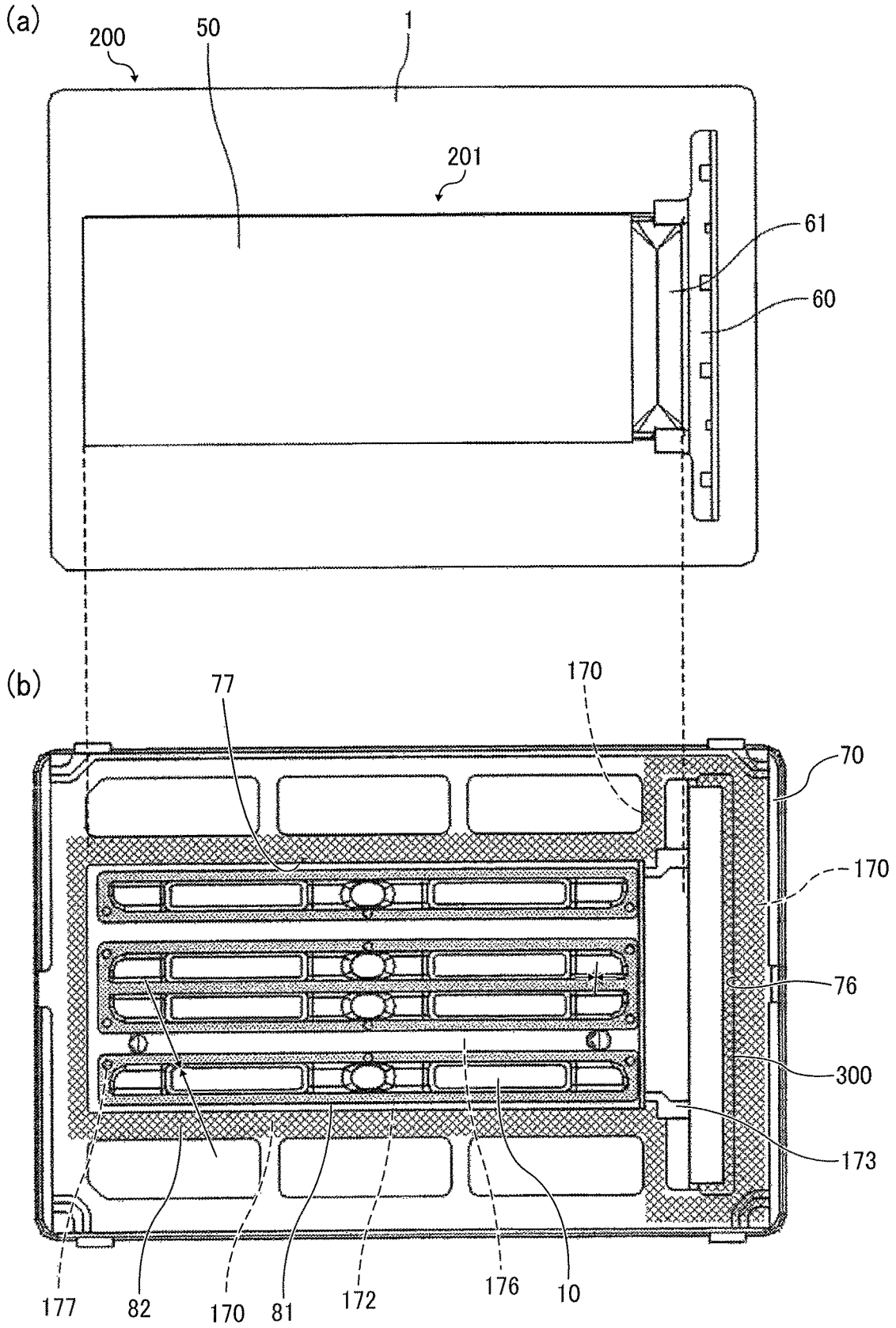
FIG. 28 is a plan view of application areas of the adhesive of the frame substrate, application areas of a sealing agent, and a filling area of another sealing agent in the fourth embodiment.

Next, the application areas of the adhesive of the frame substrate, the arrangement area of the sealing agent, and the filling area of the sealing agent are described with reference to FIG. 28. FIG. 28 is a plan view of the frame substrate and the structural body seen from the bonding surface side.

Note that, in the present embodiment, an example is described in which the sealing agent 82 is used as the sealant 80 and a sealing agent 300 is used as the sealant 84.

The ribs 172 are disposed around the respective common liquid chambers 10. The adhesive 81 is applied to the bonding surfaces of the ribs 172 to be bonded to the holding substrate 50. The adhesive 81 surrounds each of the common liquid chambers 10 without interruption.

Note that, as described above, the adhesive is an adhesive that turns to be a rubber body after curing. For example, a silicone adhesive may be used as the adhesive. In some embodiments, urethane or biomass-based adhesive may be used. As an adhesive allowing more effective absorption of vibration, for example, the adhesive is preferably a modulus of elasticity of several tens MPa or lower. The adhesive can also preferably be cured by heating to reduce the curing time.

A sealing agent 82 is applied to the bonding surface of the rib 170 of the frame substrate 70, which is bonded to the nozzle plate 1. The ribs 172 are disposed around the respective common liquid chambers 10. In plan view, the sealing agent 82 is disposed surrounding the outside of areas at which the adhesive 81 is applied to the bonding surfaces of the ribs 172, which are bonded to the holding substrate 50.

The sealing agent 82 preferably has a high modulus of elasticity and a low permeability. For example, the modulus of elasticity is preferably several GPa or higher. When a heat curing adhesive is used as the sealing agent 8, the sealing agent 82 can preferably be cured simultaneously with the adhesive 81.

When the permeability of the adhesive 81 is 100 to 1000 $cc/m^2 \cdot 24$ h (unit indicating an amount (cc) of moisture that permeates an area of 1 $m^2$ of a material per 24 hours), for example, a material having a permeability of 0 to 10 $cc/m^2 \cdot 24$ h can be used for the sealing agent 82.

Next, the frame substrate 70 applied with the adhesive 81 and the sealing agent 82 are bonded to the structural body 200 attached with the wiring member 60.

The wiring member 60 is attached to one end of the actuator unit 201 in a longitudinal direction (nozzle array direction D2) of the actuator unit 201. A resin member 61 being an intermediate member is molded at a portion at which the wiring member 60 is attached to the actuator unit 201. Thus, the structural body 200 is formed by the actuator unit 201, the nozzle plate 1, and the wiring member 60.

When the structural body 200 with the wiring member 60 is bonded to the frame substrate 70, the relative positions of the structural body 200 and the frame substrate 70 are adjusted. The wiring member 60 is inserted through the port 76 disposed at the longitudinal end of the frame substrate 70. The resin member 61 is fitted into a groove 173 of the frame substrate 70.

The port 76 of the frame substrate 70, through which the wiring member 60 is inserted, is sealed with the sealing agent 300.

Figure 29:
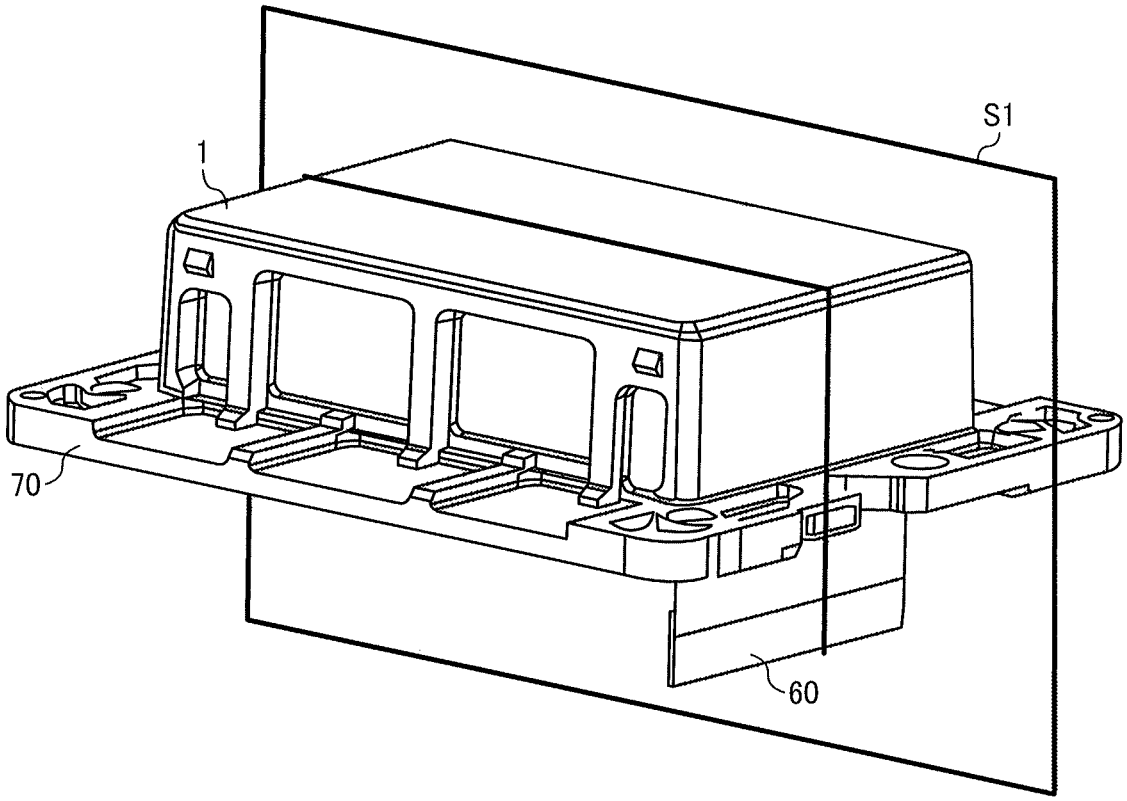
FIG. 29 is a perspective view of the frame substrate and the structural body in the bonded state in the fourth embodiment, seen from a nozzle plate side.
Figure 30:
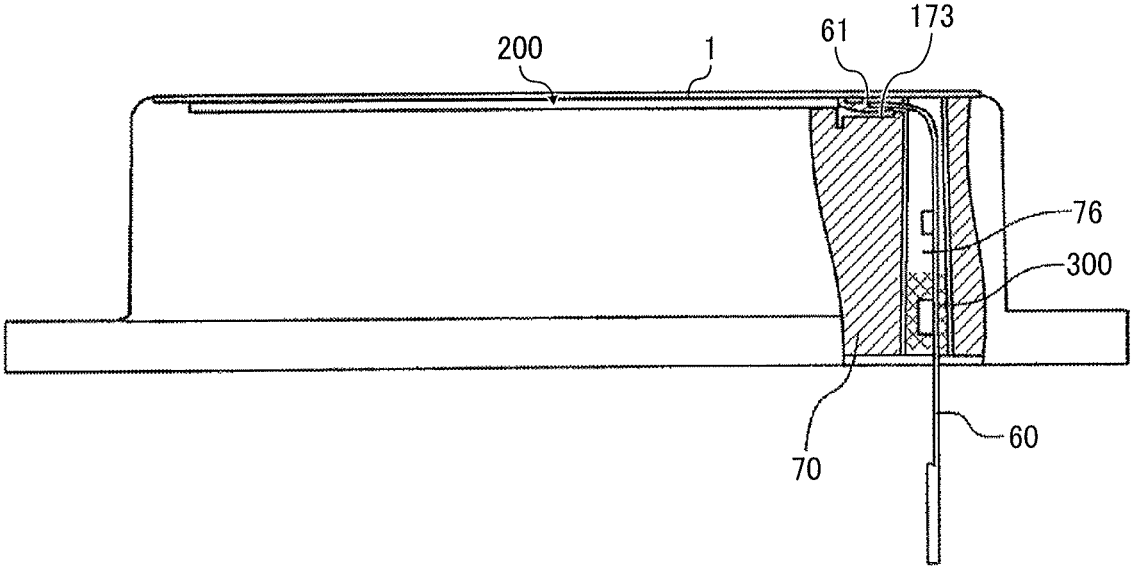
FIG. 30 is a broken cross-sectional view of a port region in a plane of FIG. 29.
Figure 31:
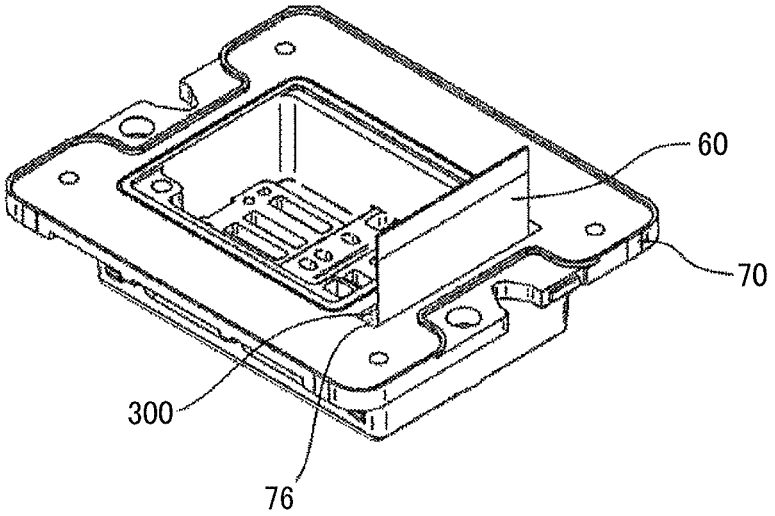
FIG. 31 is a perspective view of the frame substrate and the structural body in the bonded state in the fourth embodiment, seen from a frame substrate side.
Figure 32:
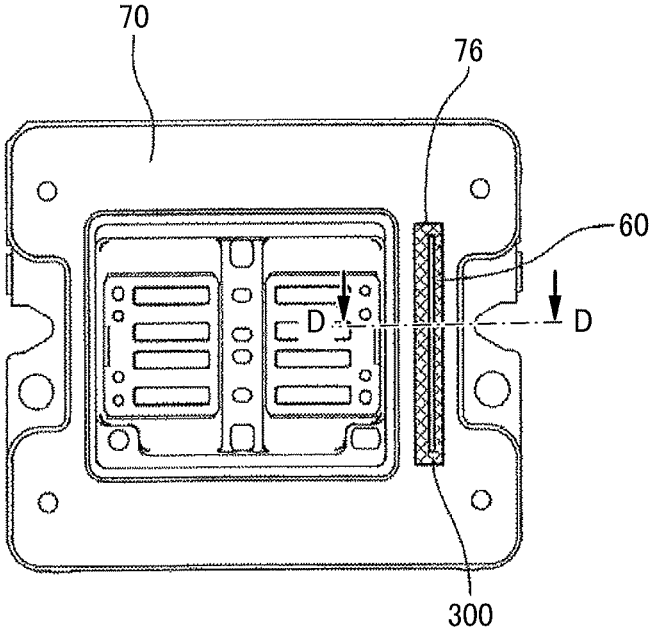
FIG. 32 is a plan view of the frame substrate and the structural body in the bonded state in the fourth embodiment, seen from the frame substrate side.
Figure 33:
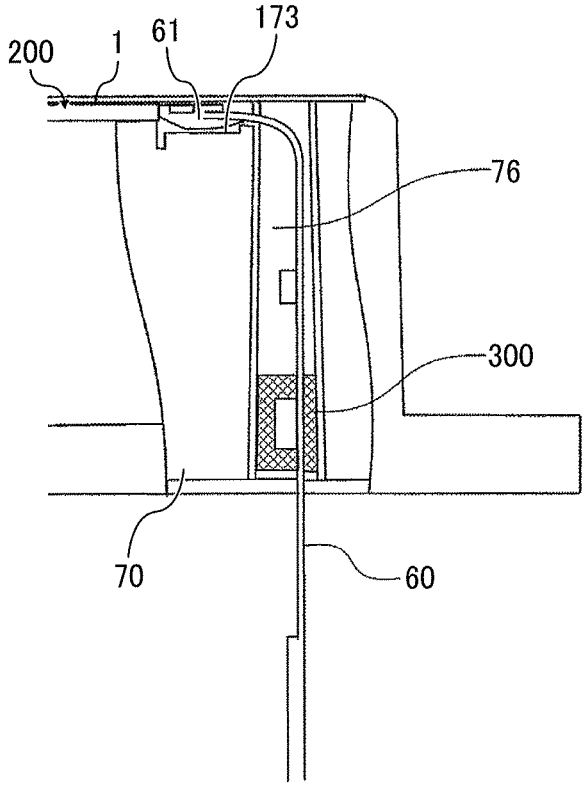
FIG. 33 is an enlarged cross-sectional view of the port region cut along line D-D of FIG. 32.

Next, a bonding state of the frame substrate and the structural body is described with reference to FIGS. 29 to 33. FIG. 29 is a perspective view of the frame substrate and the structural body in the bonded state, seen from the nozzle plate side. FIG. 30 is a broken cross-sectional view of a port region in plane S1 of FIG. 29. FIG. 31 is a perspective view of the frame substrate and the structural body in the bonded state, seen from the frame substrate side. FIG. 32 is a plan view of the frame substrate and the structural body in the bonded state, seen from the frame substrate side. FIG. 33 is an enlarged cross-sectional view of the port region cut along line D-D of FIG. 32.

As described above, the adhesive 81 and the sealing agent 82 are applied to the frame substrate 70, and the structural body 200 is bonded to the frame substrate 70. For example, by heating the adhesive 81 and the sealing agent 82 to cure the adhesive 81 and the sealing agent 82, as illustrated in FIGS. 19 to 22, respective components, such as the frame substrate 70 and the structural body 200, are bonded together with the adhesive 81 or the sealing agent 82.

Here, as illustrated in FIG. 19, the adhesive 81 around the common liquid chamber 10 to bond the frame substrate 70 to the holding substrate 50 partially faces the common liquid chamber 10.

Such a configuration allows damping of pressure waves propagated through the openings 51.

When the structural body 200 and the frame substrate 70 are bonded together, the wiring member 60 connected to the structural body 200 is in a state in which the wiring member 60 is led out through the port 76 at the longitudinal end of the frame substrate 70.

At this time, the adhesive 81 is communicated with outside air through the port 76 via the groove 173 that is disposed in the frame substrate 70 to accommodate the resin member 61 molded at the portion at which the wiring member 60 is attached to the actuator unit 201.

Hence, to block the adhesive 81 from outside air, as illustrated in FIG. 33, the sealing agent 300 is applied (filled) so as to surround the wiring member 60 led out from the port 76 of the frame substrate 70. The sealing agent 300 applied to the port 76 covers the port 76.

The sealing agent 300 can preferably be cured at room temperature. One reason of the preference is that, similarly with the above-described sealant 95, if a sealed space is cured by heating, the sealing agent might be broken by air expansion, thus causing a path of leakage.

Highly-humid air is flown into an area between the sealant and the adhesive 81 in an inner area of the sealant, and the wiring member 60 is surround by the sealing agent 300. The port 76 is filled with the sealing agent 300 to seal the port 76. Thus, the adhesive 81 can be blocked from outside air.

As described above, the sealant is disposed surrounding the adhesive 81 so as to include the areas surrounded by the adhesive 81, and the port 76, through which the wiring member 60 is inserted, is sealed with the sealant. Such a configuration can reduce thickening of liquid due to the permeability of the adhesive 81, thus reducing discharge failure due to use of the adhesive 81.

Bonding of the common-liquid-chamber substrate (the frame substrate 70) and the holding substrate 50 with the adhesive 81 absorbs and damps the vibration of the holding substrate 50. Such a configuration can reduce instability of discharge properties due to the propagation of the vibration of the holding substrate 50 to the common-liquid-chamber substrate (the frame substrate 70).

Figure 34:
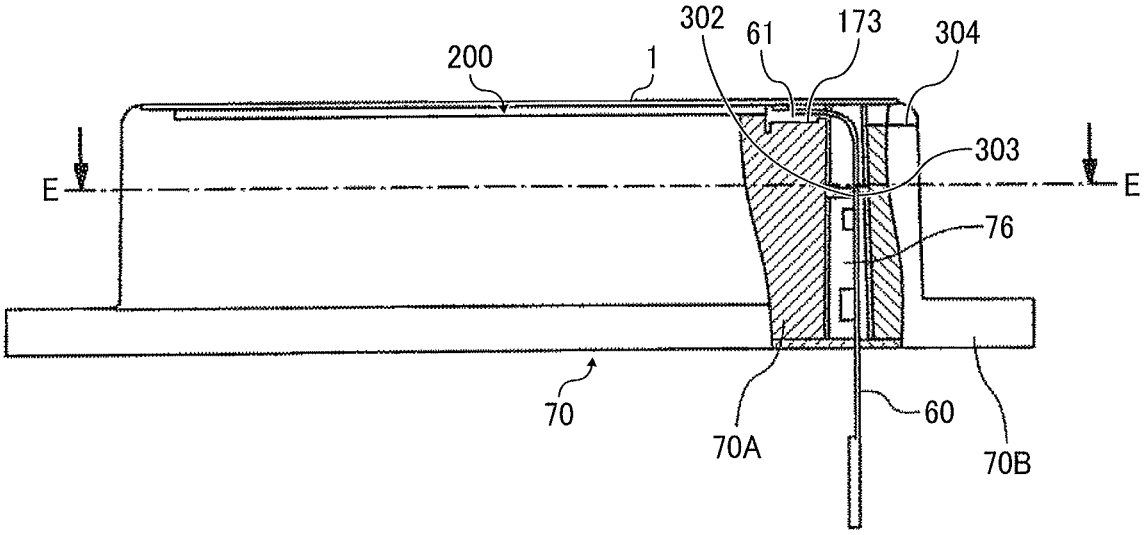
FIG. 34 is a partially-broken cross-sectional view of the liquid discharge head according to a fifth embodiment of the present disclosure, cut along a longitudinal direction of the liquid discharge head.
Figure 35:
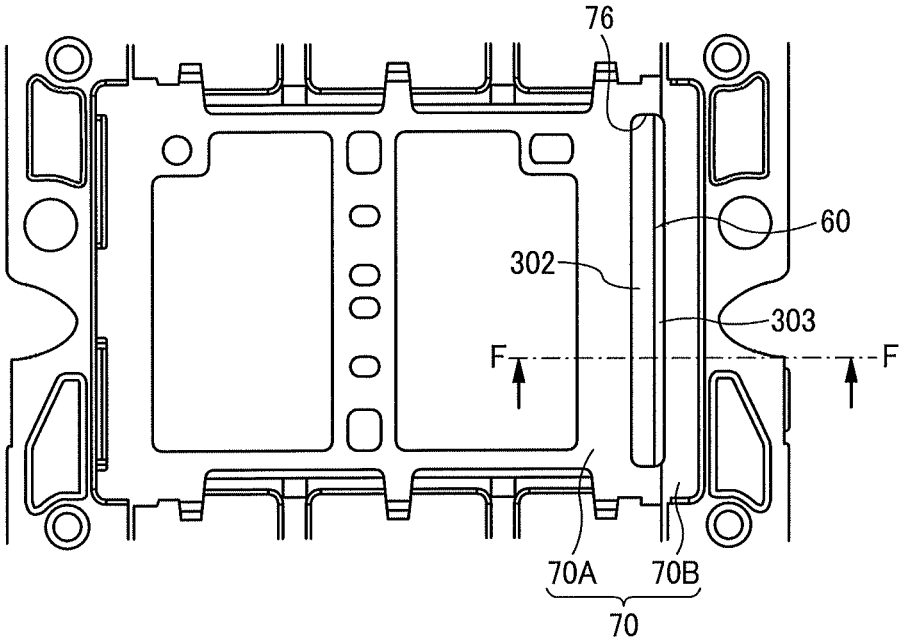
FIG. 35 is a cross-sectional plan view of the liquid discharge head cut along line E-E of FIG. 34.
Figure 36:
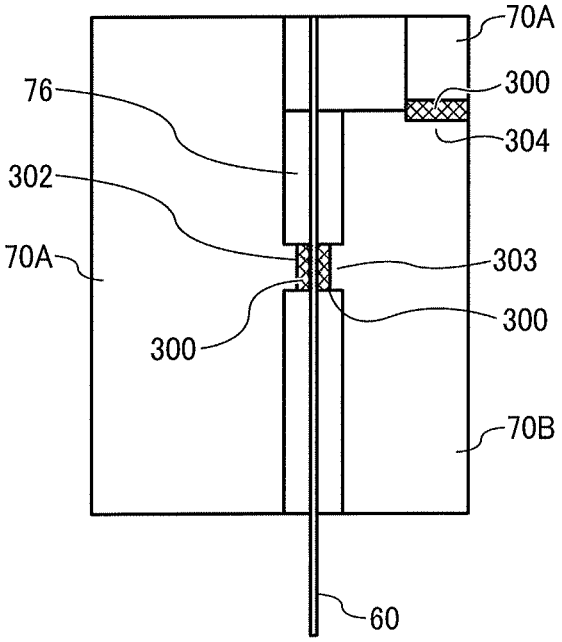
FIG. 36 is an enlarged cross-sectional view of the port region of the liquid discharge head, cut along line F-F of FIG. 35.
Figure 37:
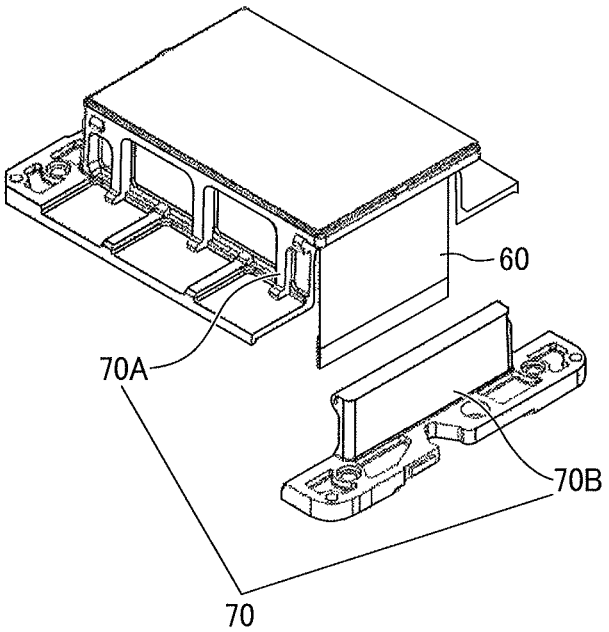
FIG. 37 is an exploded perspective view of the liquid discharge head of FIG. 34.

Next, a fifth embodiment of the present disclosure is described with reference to FIGS. 34 to 38C. FIG. 34 is a partially-broken cross-sectional view of the liquid discharge head according to the fifth embodiment, cut along the longitudinal direction (line C-C of FIG. 24). FIG. 35 is a cross-sectional plan view of the liquid discharge head cut along line E-E of FIG. 34. FIG. 36 is an enlarged cross-sectional view of a port region cut along line F-F of FIG. 35. FIG. 37 is an exploded perspective view of the liquid discharge head. FIGS. 38A to 38D are perspective views of the frame substrate of the liquid discharge head in assembly steps.

In the present embodiment, the frame substrate 70 includes a first frame portion 70A as a first member and a second frame portion 70B as a second member that are bonded together. The second frame portion 70B is divided from the first frame portion 70A at the port 76, through which the wiring member 60 is inserted, in the longitudinal direction of the liquid discharge head. In the direction perpendicular to the surface of the liquid discharge head, the second frame portion 70B is divided from the first frame portion 70A at a rib 304, with a bonding portion to the nozzle plate 1 left in the first frame portion 70A.

The first frame portion 70A and the second frame portion 70B have ribs 302 and 303, respectively, for sealing-agent application at positions opposite each other via the wiring member 60 on sides at which the port 76 is disposed in the bonded state. The second frame portion 70B has the rib 304 to bond to the first frame portion 70A in the direction perpendicular to the surface of the liquid discharge head.

The sealing agent 300 seals a space between the rib 302 of the first frame portion 70A and the wiring member 60 and a space between the rib 303 of the second frame portion 70B and the wiring member 60. The sealing agent 300 seals the port 76.

As described above, the frame substrate 70 includes the first frame portion 70A and the second frame portion 70B divided at the portion of the port 76. Such a configuration allows the rib 302 and the rib 303 to be disposed a side closer to the nozzle plate 1.

Accordingly, the amount of the sealing agent can be smaller than a configuration in which the port 76 is entirely sealed with the sealing agent 300, and the port 76 can be sealed with the sealing agent 300 at a position closer to the holding substrate 50 on which the adhesive 81 is disposed.

Here, an assembly process of the frame substrate is described with reference to FIGS. 38A to 38D. FIGS. 38A to 38D are perspective views of the frame substrate in the assembly process in an embodiment of the present disclosure.

Figure 38A:
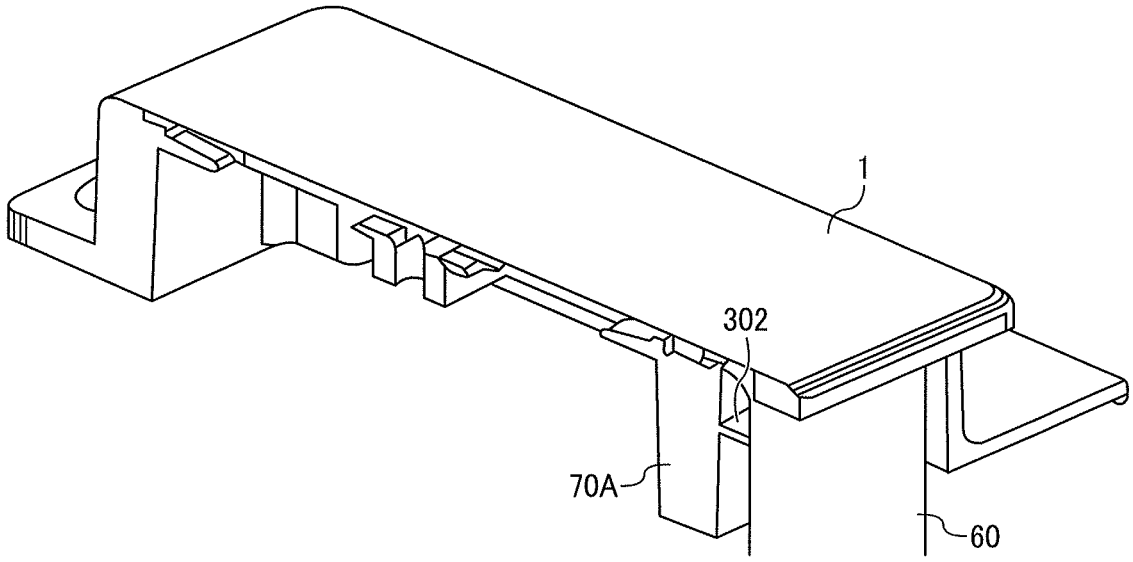
FIGS. 38A to 38D are perspective views of the frame substrate of the liquid discharge head of FIG. 34 in assembly steps.

As illustrated in FIG. 38A, first, parts other than the second frame portion 70B are assembled.

Figure 38B:
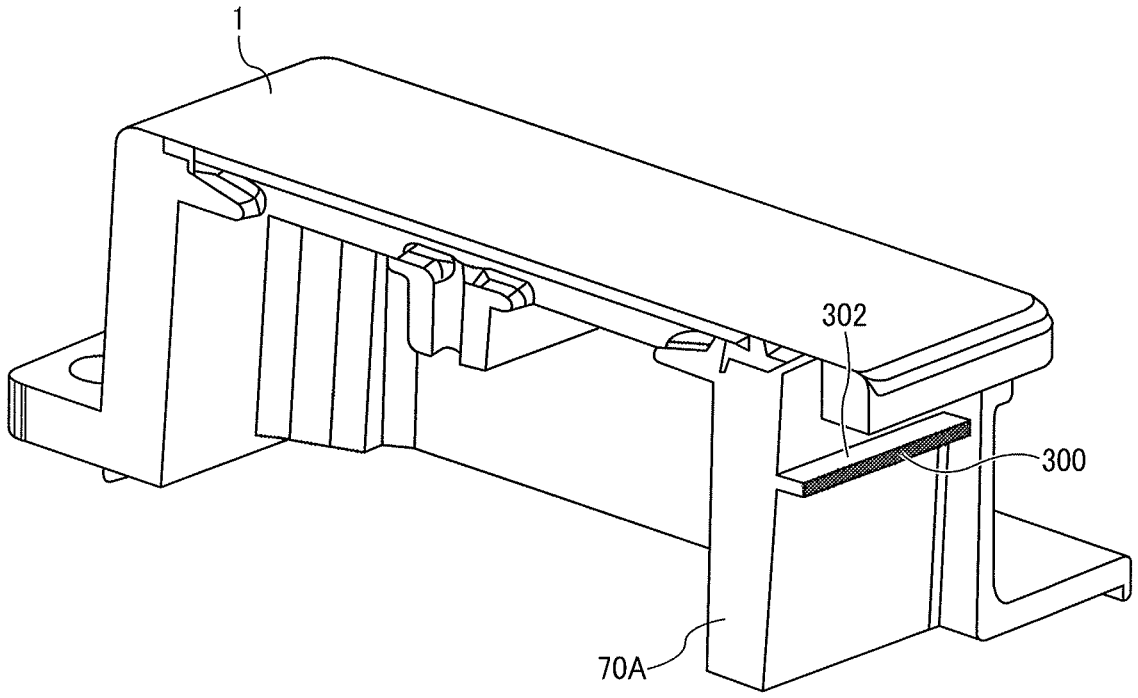

As illustrated in FIG. 38B, the sealing agent 300 is applied to the rib 302 disposed on which the port 76 of the first frame portion 70A is formed, and the wiring member 60 is disposed on the sealing agent 300 having been applied to the rib 302.

Figure 38C:
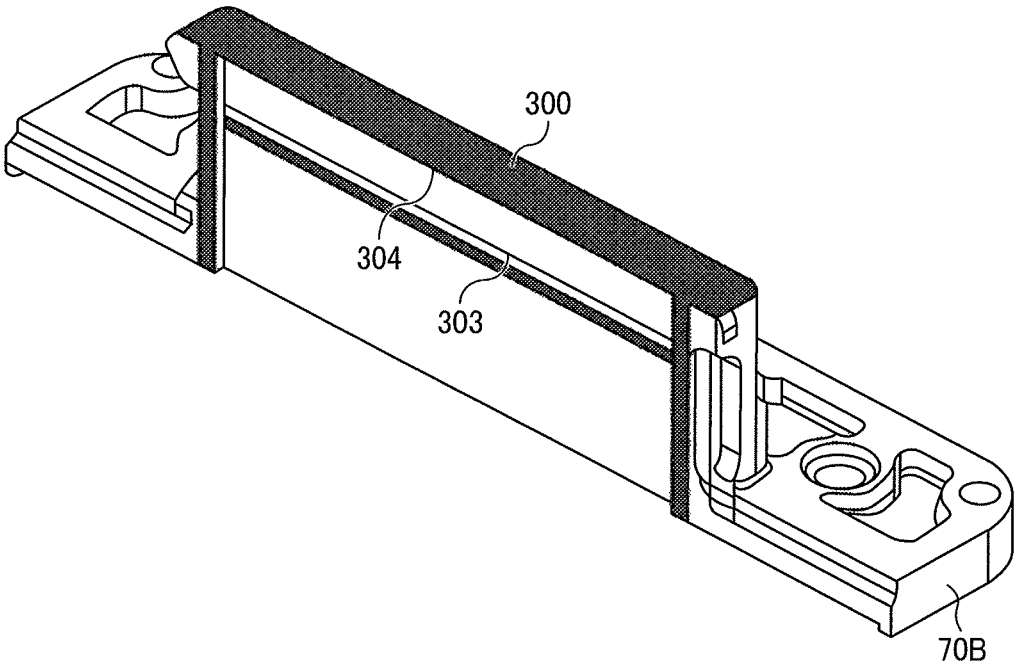

As illustrated in FIG. 38C, the sealing agent 300 is applied to the rib 303 of the second frame portion 70B facing the rib 302 of the first frame portion 70A. The sealing agent 300 is also applied to the rib 304 and bonded portions at both sides in the short direction of the liquid discharge head.

Figure 38D:
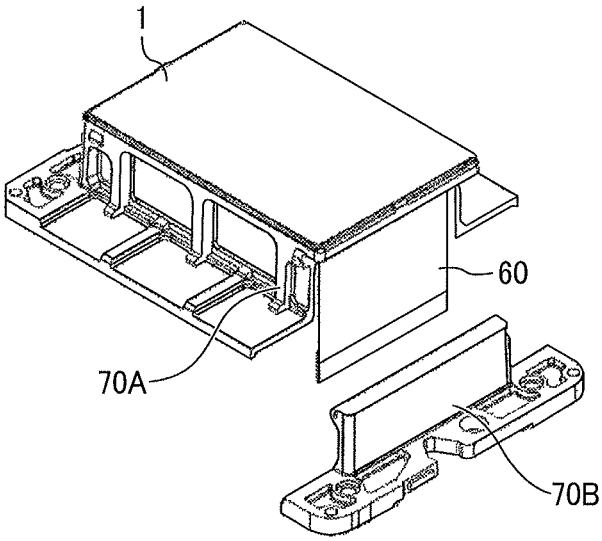

As illustrated in FIG. 38D, the positions of the first frame portion 70A and the second frame portion 70B are adjusted to form the port 76 of the frame substrate 70.

The second frame portion 70B is bonded to the first frame portion 70A. At this time, as described above, the periphery of the wiring member 60, including the space between the rib 302 of the first frame portion 70A and the wiring member 60 and the space between the rib 303 of the second frame portion 70B and the wiring member 60, is surrounded and sealed with the sealing agent 300.

An overlapping surface of the first frame portion 70A and the second frame portion 70B is sealed with the sealing agent 300 applied to the rib 304 of the second frame portion 70B.

Accordingly, the adhesive 81 is blocked from outside air with the sealing agent 300 applied to the rib 302 of the first frame portion 70A, the sealing agent 300 applied to the rib 303 of the second frame portion 70B, and the sealing agent 300 applied to the rib 304 of the second frame portion 70B.

Figure 39:
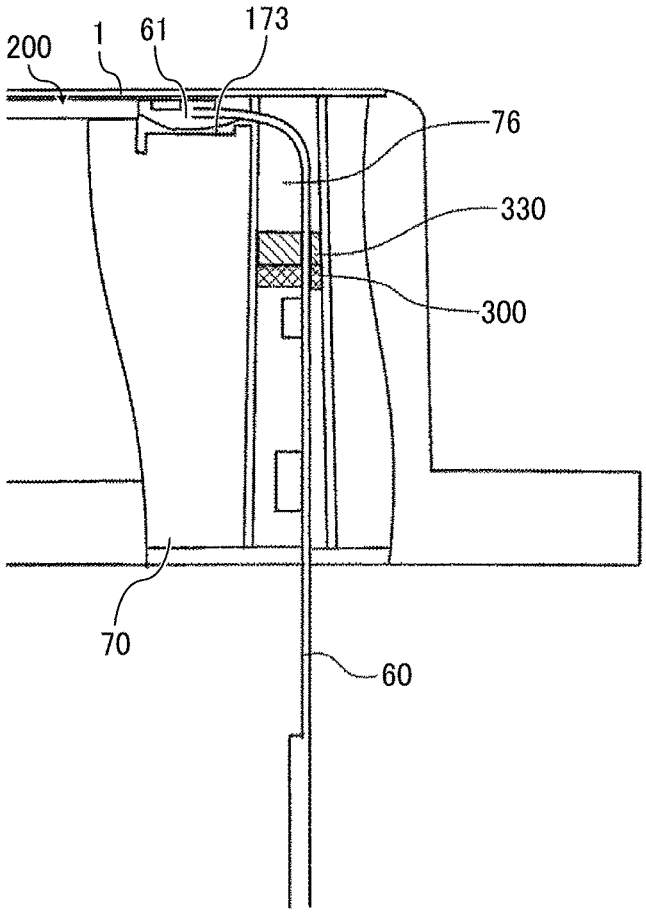
FIG. 39 is an enlarged cross-sectional view of the port region of the frame substrate of the liquid discharge head according to a sixth embodiment of the present disclosure.

Next, a sixth embodiment of the present disclosure is described with reference to FIG. 39. FIG. 39 is an enlarged cross-sectional view of the port region of the frame substrate of the liquid discharge head according to the sixth embodiment.

In the present embodiment, a spacer 330 is disposed between the wiring member 60 and a wall face of the port 76. The sealing agent 300 is filled to a first side of the spacer 330 opposite a second side at which the spacer 330 faces the nozzle plate 1. The spacer 330 has for example, a clip structure to facilitate attachment to the wiring member 60.

Such a configuration allows reliable sealing with a lower amount of the sealing agent 300 while reducing the inflow of the sealing agent 300 into the port 76.

Next, a seventh embodiment of the present disclosure is described below. The seventh embodiment is described with reference to FIG. 23, which is used in the above description of the second embodiment.

In the above-described third embodiment, as the sealant, an elastic member, such as a gasket, is used instead of the adhesive sealing agent.

For example, an elongate gasket, such as endless rubber, is disposed over the rib 170, the ribs 171*b*, and the groove 173 of the frame substrate 70 that are the application areas of the sealing agent 82 illustrated in FIG. 23. In addition, the adhesive 83 is applied to the same region illustrated in FIG. 23.

With the gasket interposed between the frame substrate 70 and each of the nozzle plate 1 and the resin member 61 of the actuator unit 201, the nozzle plate 1 and the actuator unit 201 are bonded to the frame substrate 70 with the adhesive 81.

Accordingly, in plan view, the sealant can be disposed surrounding the adhesive 81 facing the common liquid chamber 10.

Note that the configuration of the seventh embodiment in which the gasket is used as the sealant is applicable to any of the above-described fourth to sixth embodiments.

Figure 40:
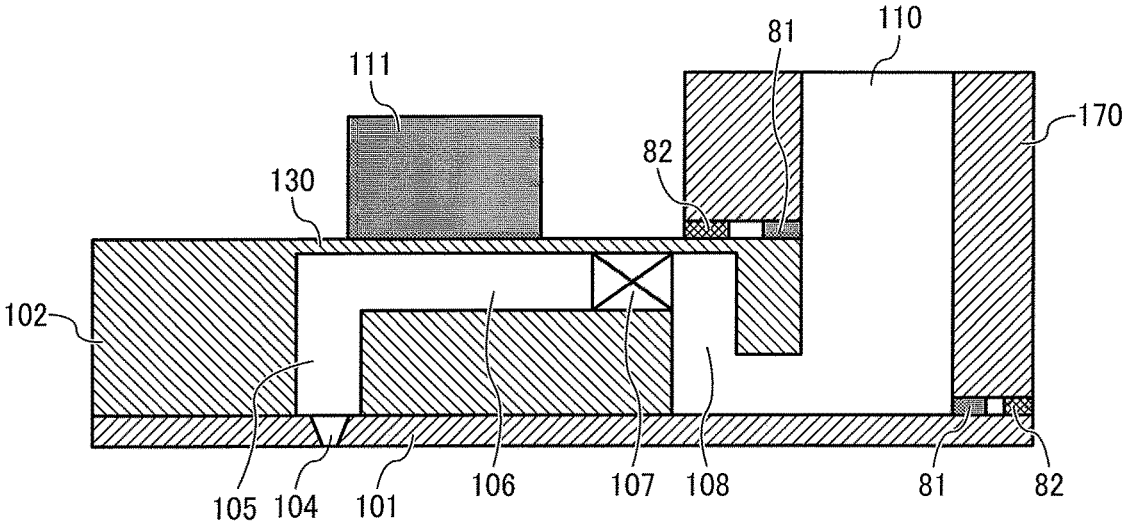
FIG. 40 is a cross-sectional view of a portion of the liquid discharge head according to an eighth embodiment of the present disclosure.

Next, an eighth embodiment of the present disclosure is described with reference to FIG. 40. FIG. 40 is a cross-sectional view of a portion of the liquid discharge head according to the eighth embodiment.

In the present embodiment, the nozzle plate 101 and a channel substrate 102 are laminated one on another. A frame substrate 170 as the common-liquid-chamber substrate is bonded to the nozzle plate 101 and the channel substrate 102 at different heights. The common liquid chamber 110 is disposed at the outer circumferential side of the channel substrate 102.

Note that the nozzles 104 are formed in the nozzle plate 101 and the channel substrate 102 includes, e.g., an individual liquid chamber 106, a fluid restrictor 107, a liquid inlet 108, and a communication passage 105. A piezoelectric element 111 is disposed on a vibration portion 130.

In the present embodiment, the frame substrate 170 and the nozzle plate 101 are bonded together with the adhesive 81 facing the common liquid chamber 110. The sealing agent 82 as the sealant is disposed surrounding the adhesive 81 at an opposite side of the channel (the common liquid chamber 110) relative to the adhesive 81.

The frame substrate 170 and the channel substrate 102 are bonded together with the adhesive 81 facing the common liquid chamber 110. The sealing agent 82 as the sealant is disposed surrounding the adhesive 81 at an opposite side of the channel (the common liquid chamber 110) relative to the adhesive 81.

In the present embodiment, bonding of the holding substrate constituting the channel substrate and the common-liquid-chamber substrate, bonding of the channel substrate and the common-liquid-chamber substrate, and bonding of the nozzle plate and the common-liquid-chamber substrate are described above. However, bonded members are not limited to the above-described members. For example, the above-described bonding is applicable to bonding of portions facing channels or liquid chambers between (two parts of) liquid-channel or liquid-chamber formation members (e.g., the above-described nozzle plate, channel plate, diaphragm plate, holding substrate, common-liquid-chamber substrate), such as bonding of the nozzle plate and the channel plate (the channel substrate).

Figure 41:
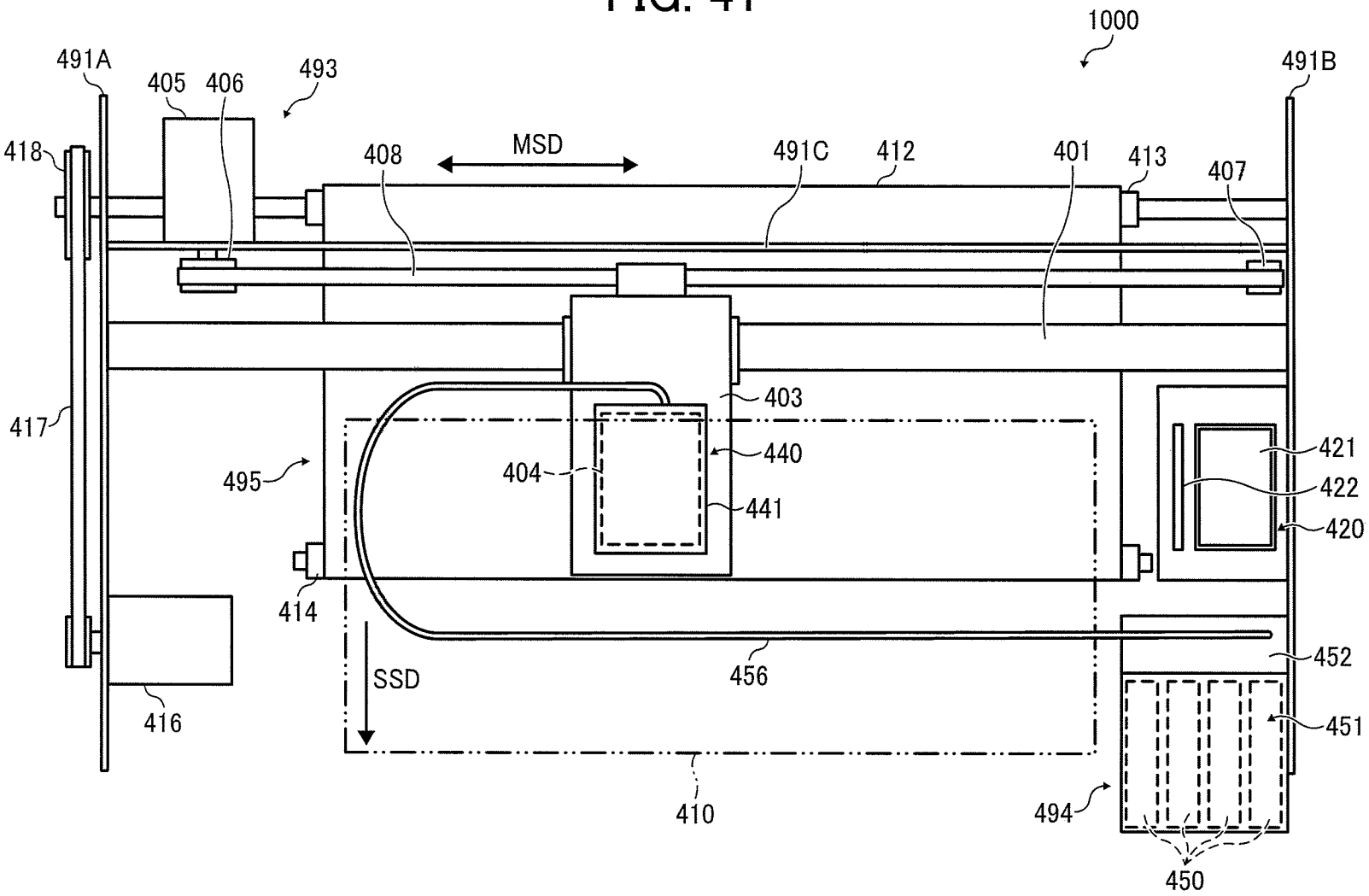
FIG. 41 is a plan view of a portion of a liquid discharge apparatus according to an embodiment of the present disclosure.
Figure 42:
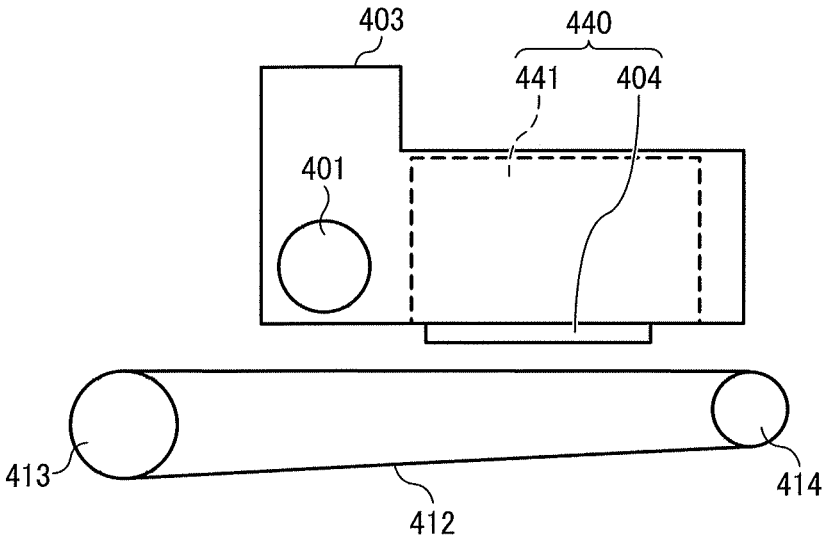
FIG. 42 is a side view of a portion of the liquid discharge apparatus of FIG. 41 including a liquid discharge device.

Next, a liquid discharge apparatus according to an embodiment of the present disclosure is described with reference to FIGS. 41 and 42. FIG. 41 is a plan view of a portion of the liquid discharge apparatus according to an embodiment of the present disclosure. FIG. 42 is a side view of a portion of the liquid discharge apparatus of FIG. 41.

A liquid discharge apparatus 1000 according to the present embodiment is a serial-type apparatus in which a main scan moving unit 493 reciprocally moves a carriage 403 in a main scanning direction indicated by arrow MSD in FIG. 41. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 41, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 1000 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 1000 thus configured, a sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 1000 includes the liquid discharge head 404 according to an embodiment of the present disclosure, thus allowing stable formation of high quality images.

Figure 43:
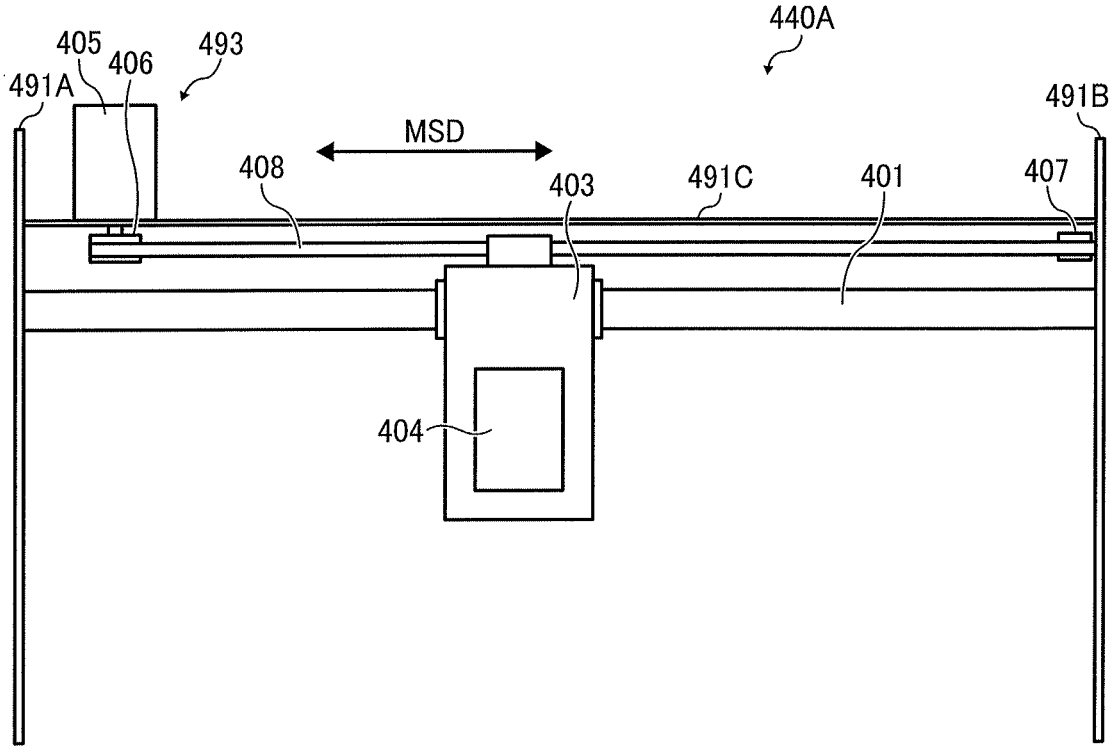
FIG. 43 is a plan view of a portion of the liquid discharge device according to another embodiment of the present disclosure.

Next, another example of the liquid discharge device according to an embodiment of the present disclosure is described with reference to FIG. 43. FIG. 43 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 1000. The left side plate 491A, the right side plate 491B, and the rear side plate 491C form the housing.

Note that, in the liquid discharge device 440A, at least one of the maintenance unit 420 and the supply unit 494 may be mounted on, for example, the right side plate 491B.

Figure 44:
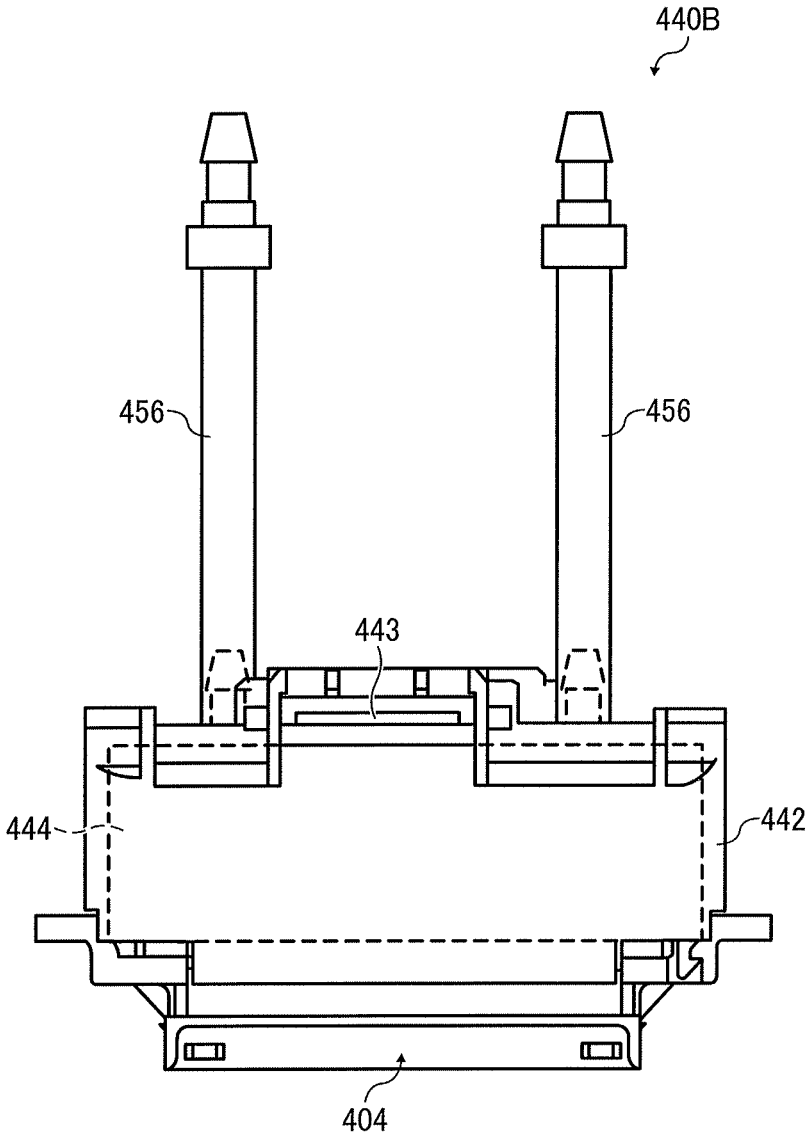
FIG. 44 is a front view of the liquid discharge device according to still another embodiment of the present disclosure.

Next, still another example of the liquid discharge device according to an embodiment of the present disclosure is described with reference to FIG. 44. FIG. 44 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

In the above-described embodiments of the present disclosure, the liquid discharge apparatus includes the liquid discharge head or the liquid discharge device, and drives the liquid discharge head to discharge liquid. Examples of the liquid discharge apparatus include an apparatus capable of discharging liquid to a material to which liquid can adhere and an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

Examples of the liquid are, e.g., ink, treatment liquid, DNA sample, resist, pattern material, binder, mold liquid, or solution and dispersion liquid including amino acid, protein, or calcium.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, the integrated unit may also be a combination in which the liquid discharge head and a functional part(s) are secured to each other through, e.g., fastening, bonding, or engaging, or a combination in which one of the liquid discharge head and a functional part(s) is movably held by another. The liquid discharge head may be detachably attached to the functional part(s) or unit(s) s each other.

The liquid discharge device may be, for example, a liquid discharge device in which the liquid discharge head and the head tank are integrated as a single unit, such as the liquid discharge device 440 illustrated in FIG. 42. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main-scanning moving device, so that the liquid discharge head and the main-scanning moving device are integrated as a single unit. Like the liquid discharge device 440A illustrated in FIG. 43, the liquid discharge device may be an integrated unit in which the liquid discharge head, the carriage, and the main scan moving unit are integrally formed as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Like the liquid discharge device 440B illustrated in FIG. 44, the liquid discharge device may be an integrated unit in which the tube is connected to the liquid discharge head mounting the head tank or the channel part so that the liquid discharge head and the supply unit are integrally formed.

The main-scan moving unit may be a guide only. The supply unit may be a tube(s) only or a loading unit only.

The pressure generator used in the liquid discharge head is not limited to a particular-type of pressure generator. The pressure generator is not limited to the piezoelectric actuator (or a layered-type piezoelectric element) described in the above-described embodiments, and may be, for example, a thermal actuator that employs a thermoelectric conversion element, such as a thermal resistor or an electrostatic actuator including a diaphragm and opposed electrodes.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a nozzle plate including a plurality of nozzles to discharge liquid;

a channel substrate including a channel plate and a holding substrate bonded to the channel plate, the channel plate including a plurality of individual liquid chambers formed therein to communicate with the plurality of nozzles;

a common-liquid-chamber substrate including a common liquid chamber to supply the liquid to the plurality of individual liquid chambers;

an adhesive bonding the holding substrate and the common-liquid-chamber substrate and facing the common liquid chamber; and a sealant disposed between the nozzle plate and the common-liquid-chamber substrate and surrounding the adhesive, wherein the adhesive and the sealant are free of overlapping with each other in a plan view of the common-liquid-chamber substrate.

2. The liquid discharge head according to claim 1, wherein the sealant collectively surrounds a plurality of areas, in each of which the channel is surrounded by the adhesive.

3. The liquid discharge head according to claim 1, wherein the sealant is a heat-curing sealing agent.

4. The liquid discharge head according to claim 1, wherein the sealant is an epoxy adhesive, and wherein the adhesive is a silicone adhesive.

5. The liquid discharge head according to claim 1, wherein the holding substrate includes one or more channels formed therein, to supply the liquid from the common liquid chamber to the plurality of individual liquid chambers.

6. The liquid discharge head according to claim 1, wherein the common-liquid-chamber substrate includes:

a first rib constituting a bonding surface bonded to the holding substrate with the adhesive; and a second rib facing the nozzle plate with the sealant interposed between the second rib and the nozzle plate, and wherein the first rib and the second rib are disposed at different positions in height in a direction perpendicular to a surface of the nozzle plate in which the plurality of nozzles is formed.

7. The liquid discharge head according to claim 1, further comprising:

a wiring member at one longitudinal end of the holding substrate; and an intermediate member disposed on the holding substrate and interposed between the wiring member and the holding substrate, wherein the sealant is disposed between the common-liquid-chamber substrate and the intermediate member.

8. The liquid discharge head according to claim 7, wherein the common-liquid-chamber substrate includes a groove into which the intermediate member is fit, and wherein the sealant is disposed in the groove between the common-liquid-chamber substrate and the intermediate member disposed on the holding substrate.

9. The liquid discharge head according to claim 1, wherein the common-liquid-chamber substrate includes a through hole communicated with a space, and wherein the through hole is sealed.

10. The liquid discharge head according to claim 1, wherein the sealant has a higher modulus of elasticity than the adhesive, and wherein the nozzle plate and the common-liquid-Chamber substrate are bonded with the sealant in an outer area than an area in which the common-liquid-chamber substrate and the holding substrate are bonded with the adhesive.

11. The liquid discharge head according to claim 1, further comprising:

a wiring member at one longitudinal end of the holding substrate, wherein the common-liquid-chamber substrate includes a port to lead the wiring member, wherein the wiring member is disposed in the port of the common-liquid-chamber substrate, and wherein a surrounding of the wiring member in the port is sealed.

12. The liquid discharge head according to claim 11, wherein the common-liquid-chamber substrate includes a first member and a second member divided at the port, wherein, with the first member and the second member bonded together, the first member has a rib at a side constituting part of the port and the second member has a rib at a side constituting part of the port, wherein the rib of the first member and the rib of the second member are disposed opposite each other via the wiring member, and wherein a space between the rib of the first member and the wiring member and a space between and the rib of the second member and the wiring member are sealed.

13. A liquid discharge device comprising the liquid discharge head according to claim 1 to discharge the liquid, wherein the liquid discharge head is integrated as a single unit with at least one of:

a head tank to store the liquid to be supplied to the liquid discharge head;

a carriage mounting the liquid discharge head;

a supply unit to supply the liquid to the liquid discharge head;

a maintenance unit to maintain and recover the liquid discharge head; and a main scan moving unit to move the liquid discharge head in a main scanning direction.

14. A liquid discharge apparatus comprising the liquid discharge head according to claim 1 to discharge the liquid.

15. The liquid discharge head according to claim 1, wherein the common-liquid-chamber substrate includes one or more first horizontal surfaces disposed at a first planar level and bonded by the adhesive to the holding substrate, and the common-liquid-chamber substrate includes one or more second horizontal surfaces disposed parallel to the nozzle plate and at a second planar level different in a liquid ejection direction than the first planar level, at least part of the sealant being disposed between the nozzle plate and one or more second horizontal surfaces of the common liquid chamber substrate.

16. The liquid discharge head according to claim 1, wherein the common-liquid-chamber substrate is bonded by the adhesive to one or more bonding areas at a first planar level on a first opposing surface of the holding substrate, and at least part of the sealant is disposed between the common liquid chamber substrate and one or more sealing areas at a second opposing surface of the nozzle plate at a second planar level different in a liquid ejection direction than the first planar level.

17. A liquid discharge head comprising:

a nozzle plate including a plurality of nozzles to discharge liquid;

a channel substrate including a plurality of individual liquid chambers communicated with the plurality of nozzles;

a common-liquid-chamber substrate including a common liquid chamber to supply the liquid to the plurality of individual liquid chambers;

an adhesive bonding two of the nozzle plate, the channel substrate, and the common-liquid-chamber substrate, the adhesive facing a channel through which the liquid flows; and a sealant surrounding the adhesive at an opposite side of the channel relative to the adhesive in a plan view of the liquid discharge head, wherein at least one portion of the sealant is disposed at a different position in height from another portion of the sealant in a direction perpendicular to a surface of the nozzle plate in which the plurality of nozzles is formed.

18. The liquid discharge head according to claim 17, wherein the channel substrate includes:

a channel plate including the plurality of individual liquid chambers; and a holding substrate including one or more channels to supply the liquid from the common liquid chamber to the plurality of individual liquid chambers, and wherein the sealant is disposed between the nozzle plate and the common-liquid-chamber substrate and between the holding substrate and the common-liquid-chamber substrate.

19. The liquid discharge head according to claim 17, wherein the common-liquid-chamber substrate includes a through hole communicated with a space, wherein the common-liquid-chamber substrate is connected to a damper unit, the damper unit including:

a deformable damper constituting part of a wall face of the common liquid chamber; and a damper plate holding the damper, wherein the damper plate includes a through hole communicated with the through hole of the common-liquid-chamber substrate, and wherein the though hole of the damper plate is sealed.

20. A liquid discharge head comprising:

a nozzle plate including a plurality of nozzles to discharge liquid;

a channel substrate including a plurality of individual liquid chambers communicated with the plurality of nozzles;

a common-liquid-chamber substrate including a common liquid chamber to supply the liquid to the plurality of individual liquid chambers;

an adhesive bonding two of the nozzle plate, the channel substrate, and the common-liquid-chamber substrate, the adhesive facing a channel through which the liquid flows; and a sealant surrounding the adhesive at an opposite side of the channel relative to the adhesive in a. plan view of the liquid discharge head, wherein the common-liquid-chamber substrate includes a through hole communicated with a space, and the through hole is sealed, wherein the channel substrate includes a piezoelectric element, and wherein the piezoelectric element is electrically connected to a wiring member, and the wiring member is led out from the through hole, and wherein a portion of sealant seals the through hole in a state of surrounding the wiring member.

* * * * *